US008287209B2

(12) United States Patent
Feldman et al.

(10) Patent No.: US 8,287,209 B2
(45) Date of Patent: Oct. 16, 2012

(54) PROTECTIVE FLOOD BARRIER SYSTEM

(76) Inventors: Boris Feldman, Thornhill (CA); Alexander Feldman, Maple (CA); Michael Feldman, Toronto (CA)

( * ) Notice: Subject to any disclaimer, the term of this patent is extended or adjusted under 35 U.S.C. 154(b) by 452 days.

(21) Appl. No.: 12/316,249

(22) Filed: Dec. 11, 2008

(65) Prior Publication Data

US 2010/0150656 A1 Jun. 17, 2010

(51) Int. Cl.
*E02B 3/04* (2006.01)

(52) U.S. Cl. ..... 405/115; 405/111; 405/76; 405/21; 405/26; 405/25

(58) Field of Classification Search ..... 405/107, 405/114, 115, 116, 15, 16, 17, 21, 23, 24, 405/25, 26, 27, 29, 30, 31, 34, 35, 75, 76, 405/110, 111

See application file for complete search history.

(56) References Cited

U.S. PATENT DOCUMENTS

| | | | | | |
|---|---|---|---|---|---|
| 1,554,605 | A * | 9/1925 | Smith | 405/35 |
| 3,191,386 | A * | 6/1965 | Wiegel et al. | 405/25 |
| 3,299,640 | A * | 1/1967 | Nielsen | 405/24 |
| 4,136,995 | A * | 1/1979 | Fish | 405/115 |
| 4,347,017 | A * | 8/1982 | Chevallier | 405/29 |
| 4,594,023 | A * | 6/1986 | O'Neill | 405/29 |
| 4,692,060 | A * | 9/1987 | Jackson, III | 405/115 |
| 4,790,685 | A * | 12/1988 | Scott et al. | 405/30 |
| 4,950,104 | A * | 8/1990 | Streichenberger | 405/24 |
| 5,059,065 | A * | 10/1991 | Doolaege | 405/115 |
| 5,125,767 | A * | 6/1992 | Dooleage | 405/115 |
| 5,154,537 | A * | 10/1992 | DeVries et al. | 405/211 |
| 5,176,468 | A * | 1/1993 | Poole | 405/23 |
| 5,238,326 | A * | 8/1993 | Creter | 405/25 |
| 5,246,307 | A * | 9/1993 | Rauch | 405/25 |
| 5,259,696 | A * | 11/1993 | Beardsley | 405/25 |
| 5,267,812 | A * | 12/1993 | Suzuki et al. | 405/25 |
| 5,575,584 | A * | 11/1996 | Alsop | 405/24 |
| 5,823,710 | A * | 10/1998 | Dooley | 405/29 |
| 5,865,564 | A * | 2/1999 | Miller et al. | 405/115 |
| 5,871,303 | A * | 2/1999 | Brown et al. | 405/24 |
| 5,899,632 | A * | 5/1999 | Martin | 405/25 |
| 6,042,301 | A * | 3/2000 | Sovran | 405/114 |
| 6,079,904 | A * | 6/2000 | Trisl | 405/107 |
| 6,142,704 | A * | 11/2000 | Coyne | 405/114 |
| 6,247,873 | B1 * | 6/2001 | Fukui | 405/17 |
| 6,334,736 | B1 * | 1/2002 | Johnson et al. | 405/114 |
| 6,364,571 | B1 * | 4/2002 | Doolaege | 405/115 |
| 6,413,014 | B1 * | 7/2002 | Melin | 405/107 |
| 6,464,429 | B2 * | 10/2002 | Moore | 405/24 |
| 6,467,993 | B1 * | 10/2002 | Utter et al. | 405/24 |
| 6,481,928 | B1 * | 11/2002 | Doolaege | 405/115 |
| 6,551,025 | B2 * | 4/2003 | Dery | 405/115 |
| 6,641,329 | B1 * | 11/2003 | Clement | 405/115 |
| 6,676,333 | B2 * | 1/2004 | Wiseman et al. | 405/114 |
| 6,783,300 | B2 * | 8/2004 | Doolaege | 405/115 |
| 7,097,385 | B2 * | 8/2006 | Tabler | 405/21 |
| 7,121,764 | B2 * | 10/2006 | Rorheim | 405/115 |
| 7,448,827 | B2 * | 11/2008 | Li | 405/114 |
| 2004/0146359 | A1 * | 7/2004 | Doolaege | 405/115 |

(Continued)

*Primary Examiner* — Frederick L Lagman

(57) ABSTRACT

Protective flood barrier system on the base of mobile protective flood barriers is offered. Each of these barriers comprises two or more filled elongate sleeves, a web, connecting theirs web and forming means. Envelops of said sleeves and said web are made from flexible impermeable material. These barriers are convenient for protection of separate houses, the extensive areas, as walls of a water basin. They allow reducing wind-induced waves and can be used for repair of earthen dams. The high-efficiency means accelerating installation of barriers are provided.

15 Claims, 29 Drawing Sheets

U.S. PATENT DOCUMENTS

2005/0163570 A1* 7/2005 Cullen ..... 405/115
2005/0260038 A1* 11/2005 Sousa Costa ..... 405/115
2007/0116522 A1* 5/2007 Boudreaux ..... 405/114

* cited by examiner

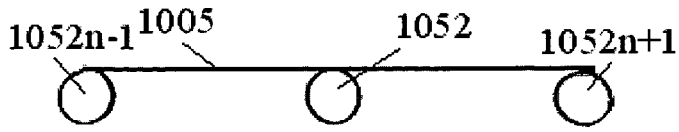
FIG. 10M_1
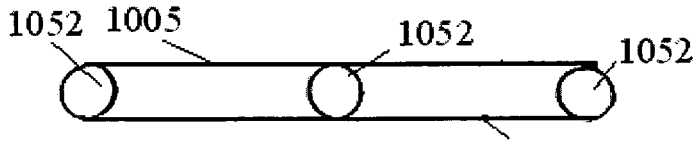
FIG. 10M_2
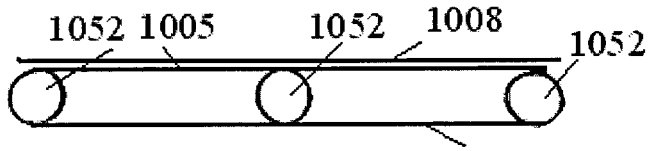
FIG. 10M_3
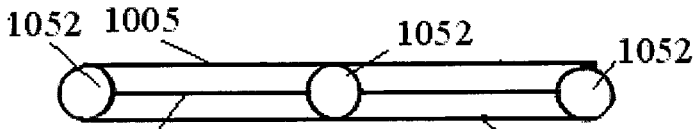
FIG. 10M_4
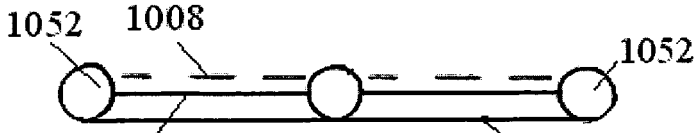
FIG. 10M_5

In this FIG. it's marked:

flood zone ▽ protected area

PROTECTIVE FLOOD BARRIER SYSTEM

CROSS-REFERENCE TO RELATED APPLICATIONS

This is the first application filed for the present invention.

TECHNICAL FIELD

The present invention relates to design of barrier systems on the base of two or more filled sleeves having flexible envelop for protection of people and building against flood.

BACKGROUND

Humanity struggles against the dangerous of natural phenomena that are caused by strong water streams or strong winds, protecting the lives and dwellings. For this purpose various means are used. One out of them is sleeves made on the basis of filled cylinders. These barriers separate one part of environment (water, air) from another, protecting from a strong wind or water streams.

The strong rains cause flooding of extensive territories and rivers and strong winds raise a water level in narrow gulfs or river mouths. Therefore the means for protection against a strong wind and flood water are necessary.

Many patents offer various designs of the barriers using cylinders, sleeves or oblong chambers filled with water or air and placed on a earth surface in the path of water stream (high water).

But the works, devoted to struggle against wind-induced incoming surge waves and subsequent flooding, it is much less. For wind-induced surge protection it is used the powerful gate-dams operating in Holland and England, projects in Venice and Russia, which are capable to separate area of high water from protected zone and which are closed only in the dangerous period and open for navigation in the rest time. Dear and complex constructions are used.

A number of the patents, devoted to the protection against the high flood water by means of the barriers comprising one, two or more tight tube-like sleeves (chambers, balloons, members) made from an flexible material (plastic, a composite, polymer), established and fixed on a ground surface on the path of a water stream is known. Thus try to reach mobility of barriers, simplicity to their installation and fixing.

Two classes of the protective flood barriers located on the ground and using two or more tube-like sleeves with impermeable envelops and filled by filler are known. Barriers of first class comprise one or more sleeves located in side-by-side, and Barriers of second class comprise two or more sleeves removed from each other, connected by a web, on which the pressing down ballast is placed.

Designs made on the basis of one sleeve demand an obligatory attachment to the ground by means of preliminary prepared fastenings on the ground surface. An example serves U.S. Pat. No. 5,988,946 (Reed C.) wherein the inflatable barrier made from air-inflatable bubbles is described. For keeping said bubbles in collapsible state it is intended a trough that is placed between the protected area and the flooding area and said trough sides which are all preferably surfaced with concrete. It is supposed, that is in advance known, as and where it is necessary to protect. However, this decision demands to create of the complex concreted trench that dearly and is not always real.

In U.S. Pat. No. 6,957,928 Lofton M. B. offers more mobile and convenient design using augers for fastening to the ground and special rigid flanges for integration of these inflatable cylinders (tubular sleeves) by means of netting positioned over tubular sleeve that is anchored on opposite sides of tubular sleeve by said augers. However, the similar system is convenient only for small areas protection.

In U.S. Pat. No. 4,981,392 Taylor G. L. offers a water inflatable structural module for constructing temporary dikes and related structures, comprising two identical elongated flattened cylinders which are sealed at opposite lateral ends to form a sealed, watertight chamber within a cylinder. The cylinders are joined by a flexible web. Several modules may be stacked in an interlocking structure of any desired height without the use of fastening elements. These blocks are the constructive "bricks" intended for forming a laterally interlocking structure and cannot form a continuous protective barrier.

In U.S. Pat. No. 5,645,373 Jenkins J. T. describes a temporary flood control system comprising elongated flexible, inflatable, tubular member secured to each other and adapted to be disposed on the ground for anchoring a generally sheet like vertically extendable barrier wall or an inflatable tubular barrier sleeve disposed above and connected to the ballast members. These members are at least partly fillable with ballast, and may be inflated with pressurized air. Such barrier forms "an easy fence", is not adapted for the subsequent strengthening and cannot protect against strong flooding.

In Pat. Appl. US 20030118407 Henning G. and Svend A. P. offer only a method of erecting a transportable dam comprising at least one inflatable flexible element and don't offer a design of a concrete barrier.

U.S. Pat. No. 6,126,362 (Carter T. L., et al) describes the dike consisting of two different tube-like sleeves that are fastened to each other. The author uses a skirt-cloth extending from the front side of the barrier abutting against the flood side substrate surface to prevent a water leakage under the dike. However, there is a danger that at dike installation it will be necessary to straighten said skirt that requires time.

U.S. Pat. No. 5,125,767 (Dooleafe, D, 1992) is one of first patents that offered various dams formed from comprises at least a pair of water filled elongate flexible chambers interlocked in side-by-side relationship and that may incorporate additional flexible water filled bad in the ends thereof as anchors. But density of water as an anchor or a ballast is insufficient for stability of a barrier. And the top arrangement of a water bag also does not promote it. In U.S. Pat. No. 6,481,928 and U.S. Pat. No. 6,783,300 Doolaege D. offers to use two flexible sleeves located close to each other. However, a similar barrier is intended for other purpose and requires the special means of fastening in the case of flood.

Doolaege D. offers to use a zipper only for fastening end faces of sleeves (U.S. Pat. No. 6,783,300).

In U.S. Pat. No. 6,641,329 (Clement G. M.) a liquid filled dam is described. The dam may be assembled as a packet of plurality tube-like elongate flexible sleeves connected by straps. This simple design demands manual labour at its installation for said plurality separate sleeves connection.

The first prior art is the Patent RU 2093638 (Feldman B. J., 1994, 1996) is shown in FIG. 1A-C. In this patent the flood protection dam comprises two elongate flexible sleeves made from the water-proof material. These sleeves are filled with water, ground, sand, or combinations thereof, interconnected by flexible web and located on the ground and located at the predetermined distance. The space between said sleeves is occupied by the ballast (concrete blocks, stones, ground, sand, metal structures, sandbags, water or any combination of aforesaid materials). Advantages of this decision: a) two sleeves, parallel to each other and removed from each other, allow to create the bounded capacity for loading a ballast, and b) the opportunity to use said ballast having any form and volume, including a free-flowing ballast and liquid. Said ballast carries out two functions: a) supports a front sleeve and b) presses a web to the ground, interfering with water infiltration. This patent solves one of the main problems: immediate loading after mounting said barrier on the ground and so that dam resistance grew as loading the space located between said sleeves.

The similar decision is offered in U.S. Pat. No. 6,726,405, Pat. CA 2416971 (Rorheim T. O. Norvay, PCT filling date 18 Jun. 1999, WO 2000/079062), where claims 1 and 2 repeat my above-mentioned patent RU 2093638. However, further the use of air as filler weakens a resistance of such dam and isn't perspective.

A number of patents that offer folding protective barriers is known. (U.S. Pat. No. 6,692,188, Walker; U.S. Pat. No. 5,645,373, Jenkins J. T.; Pat. Appl. US 2007116522, Boudreax H. K., et al; U.S. Pat. No. 6,450,733 Krill H-J, et al; Pat. Appl. US20060072969 Obermeyer H. K., et al). Last material (US 20060072969) comprises the description of water control gates and related inflatable actuators. The design is suitable for a water gate, but too complex for creation of barriers against flooding. Besides fastening of a filled bladder(s) and the organization of a joint of a front panel and a frame are too complex.

Walker A. G., et al (U.S. Pat. No. 6,692,188) offer a folding design, using a triangle barrier and an apron connected to said barrier by a pivot. Said barrier is formed by porous panels faced to flooding and a flexible panel. However, the arrangement of the apron interferes with use of the ballast increasing resistibility of a barrier. Pegs installation demands manual skills, and the sizes of said apron are those, that it is difficult to find such free strip in real conditions (approximately up to 20 meters).

Harry B. P. (Pat. Appl. US 20020110424) offers a primitive structure contained an elongated liquid-tight container filled with a liquid, comprising an eyelet coupled to said container and secured to the ground where said eyelet and a stake are corded. This invention cannot prevent a water leakage between said container and the ground.

Baruh B. G. (U.S. Pat. No. 6,164,870) offers an inflatable dike that is consists of several sections for protecting houses and roadways. Each of said sections has an upper cover and comprises handles for lifting this cover and inflatable lower bladder. That dike requires hand-help mounting and has deficient stability by increase of high water level.

Frame structures are described in different patents. Wiseman H., et al, (U.S. Pat. No. 6,676,333) offer to use a collapsible frame structure that is consisted of several beams and consider this structures as cofferdams that demand not only require to be capable of quick assembly and disassembly for ease in erection, but and transportation and storage. The choice of such structures was defined by that said artificial cofferdams demand high durability (The beams are preferably constructed of hollow cylindrical steel tubing with an outside diameter of about four inches, having a tensile strength of around 60,000 pounds). Such structures are convenient for assembly, but demand for this significant time and leave a problem of water filtration through a cofferdam sole.

The technology an RDFW (Rapid Deployment Flood Wall) is known. It uses a modular, collapsible plastic grid that serves as a direct replacement for sandbag walls. An RDFW wall is quickly expanded into place and then filled from the top with a loader, excavator, bottom-dump, or other piece of earthmoving equipment. However, this useful technology requires "dry object" and don't allow to use such machinery as dredgers.

The aforesaid barriers are intended for flood protection directly in residential areas, cities or vicinities. However, it is known, that the significant part of floods is caused by a wind creating on the sea or lakes a surge incoming wave. The wind raises the sea level near to coast, and flooding wave falls on coast. Especially the greater wave is formed along the rivers or gulfs. A collapsible rubber dam (U.S. Pat. No. 4,498,810 by Murametsu, et al) is intended for river damming, but cannot protect against this danger.

However, similar dams have not found application to protect against surge wave. In England and in Holland are constructed, in Italy and in China (U.S. Pat. No. 7,229,234 by Lim P T) are designed powerful and dear gate-dams, capable to separate area of high water from other zone, and these gates are closed only at the dangerous period and are opened in the rest of the time for navigation.

None of these above-mentioned barriers provides simplicity and speed of assembly, fast installation at occurrence of danger, the minimal laboriousness and to resistance of a real water flow, and also protection against flooding various objects. Nobody considers designs that are allow protecting different objects on the base of united technology. The analysis of thousand illustrations that are made at the time of last flood in Yahoo gallery confirms this conclusion and shows that. Everyone practically uses only sandbags.

The present invention is based of above-mentioned patent RU 2093638. It allows raising stability of barriers, as much as possible to mechanize process of their installation and to expand an application field the offered barriers to struggle against flooding, in particular for weakening wind-induced incoming surge waves and creation of cheap water basins-traps.

The present invention allow to create a flood protective system that is able to protect different objects located on the protected area. The offered system can be cheap enough, can be quickly established and put into operation, capable to protect effectively said objects, using group of the barriers considering properties of protected objects and executed on the basis of united technology.

SUMMARY

The first aspect of the present invention consists in that the offered system includes means made on the base of united technology and allowing to create system for protection against flooding that is caused different reasons, but having one result in view of destroying cities and killing people. New design can have tour types that are convenient for creation of dam-barriers against flooding, for important buildings protection, for weakening streams of the fast river into dangerous places, for creation of additional barriers along river coasts, for creation of channels for water removal, for creation of water basins-traps walls and for weakening wind-induced incoming surge waves and for repairing dam rupture.

The following aspect consists in that the main mobile barrier is characterized in that: 1) it can be mounted very quickly, faster than any other barrier, 2) it uses only such components that each owner of the house can possess and store, 3) it can be mounted on the most private territories. Such mobile barrier can protect from flooding in height of 0.5-0.8 m at not so strong water stream. But really the flood water height may be more than 0.8 meters and said mobile barrier needs an additional supplement "a quick-installer barrier". It is known that 90% of flood damage in the United States alone is caused by flood having height in less than 1 meter of water. Following "quick-installable barrier" allows protecting an area against flood water of height 1.5 meters approximately. But even the most successful embodiment of such barrier requires more complex installation and increased installation time. But at same time it allows protecting a group of houses from strong current and more high water level. On the other hand said mobile barriers allow directly protecting houses during the time interval that it is necessarily for the installation of said quick-installable barriers, and help against water infiltration, leakages and overflow that are inevitable in the real cases. Thus, these types of barriers are complementary and are sufficient in the plain areas. However, such designs and other known designs are unable to protect against real catastrophes caused by wind-induced surge waves, tsunami waves, and streams, as well as caused by defects of dams. Katrina's experience, floods caused by surge waves and technogenic accidents confirm it. Further offered protective flood barrier system includes additional means, that allow at least weakening such dangerous water stream. Essentially partial results of action of said means weakening surge waves and tsunami waves and other similar means show that said mobile barriers and quick-installable barriers hold their importance.

All said types have a cheap design, accessible to mass production, allows preparing quickly theirs for protection against flooding.

The second aspect of present invention consists in that the creation of similar multilevel system allows to improve the quality of the protection, each of successive levels of the protection in such system weakens a hazard action, composition and arrangement of said modifications determined by the features of the protected objects and environment, surrounding relief and meteorological conditions, and said barriers can be easy-to-used together with traditional dams, widely used sandbags or RDFW technology.

The third aspect of present invention consists in that said flood protection barriers comprise two or more rows of chambers, an elongate impermeable web made from flexible material, each of said rows comprises one (a sleeve) or more said chambers, and at least one of said rows comprises said chamber(s) with flexible impermeable envelop; said sleeves and chambers are intended for filling with filler: water, ground, sand, pulp or air and the like. The space between said sleeves is occupied by the ballast (concrete blocks, stones, ground, sand, metal structures, sandbags, water sleeves or chambers or any combination of aforesaid means). The present invention allows solving the main problems: immediate loading by ballast after mounting said barrier and so that dam resistance increases as loading the space located between said sleeves. The resistance against water of such dams is increases in parallel with increasing flood water level.

The fourth aspect consists in that offered barriers may be in two state: working state when said barriers protects from flood water, and collapsed state, and said barriers being in the collapsed state are folded as package, and may be reserved and easy transported in this state to dangerous place there they are mounted and transformed to working state.

The fifth aspect of present invention consists in that offered barriers allow can be delivered to dangerous places sufficient fast using helicopters, airplanes, ekranoplanes, hybrid-dirigibles, sea ships, and the like, and mounting sufficient fast using high performance equipment (dredgers, conveyers, etc).

The following aspect of present invention consists in that ground flood protection a quick-installable barriers comprise two or more elongate sleeves. Said sleeves are made from the flexible water-proof material, are filled with water, ground, sand, combinations thereof, are interconnected by flexible web and located on the ground surface so that said sleeves are separated at the predetermined distance that is loaded by said ballast.

The seventh aspect consists in that offered a quick-installable barriers comprise forming means that allows to create transition forms of said barriers sufficiently rapid, and these forms allow to begin ballast loading and filling with filler, not waiting of completion of barrier transformation in the working state, and that are solid or pressurized flexible sleeves, providing growth of resistance against flood during the increase of its height.

The eighth aspect of present invention consists in that said forming means for the quick-installable barriers are chosen from: rigid spreaders that straighten said web in breadth, rigid springy and tube-like filled with water (or air) ribs that are opened the space between said sleeves for ballast loading.

The following aspect of present invention consists in that said system allows to use fixing means chosen from following: concrete blocks preliminary buried in a superficial ground layer, anchor units for fastening said web with the help of rope ends by "one bolt" and/or supporting blocks, supported piles, and like. Said means can comprise deepening means in the view of jet engine, heavy head. Said collapsible pontoons can be fastened on the ground winches, bottom anchors, floating underground anchors and towboats.

The following aspect consists in that said barriers includes means that interfere to sliding of said mobile and quick-installable barriers (sleeves and webs) and infiltration of water under this web (or/and sleeve), and these means are chosen as special covering, for example, hydrophobic, superhydrophobic, nanonails, and the like.

The following aspect consists in that said barriers comprise fastening coverings that allow to fasten additional flexible bands, repair web to said sleeve envelops, to fasten said sleeve envelops and said web to solid ground base (asphalt and the like), and said coverings are chosen from following: gecko adhesive, hook-and-loop fasteners and the like.

The twelfth aspect includes supersliding means (as polyacrylate and the like) that help in sliding of water along said sleeves and/or webs of said quick-installable barriers and collapsible pontoons.

The thirteenth aspect consists in that a "zipper" is used for fast connecting of separated parts of web lengthwise and to close cuts in the web. For accelerating a robot, comprising a slider, a drive and a control unit, is proposed. Such robot has to have at least two or three operations and shifts step-by-step or "tooth-by tooth".

The fourteenth aspect of present invention consists in that said barrier system comprises a car equipped by overhead conveyer in which the package of said quick-installable barrier in collapsed state is suspended on sliding elements and which allows quickly to open out a barrier in place.

The following aspect of present invention consists in that said mobile barrier is the formed as a skeleton made in the view of truss on the base of "collapsible construction equipment", said skeleton is fastened to the ground and is covered fully by the impermeable flexible web from the front and from below, and said web is fastened to said skeleton. Such design allows accelerating and simplifying installation of flood protective barriers and can be very useful if high flooding about 0.5-0.8 m.

The following aspect consists in that said collapsible pontoon is floating pontoon, comprising a plurality of sleeves located in parallel or united in the view of cellular structure of bundles consisted of several sleeves, a part of said sleeves are filled with air and said pontoon is covered by impermeable upper web, smooth or smooth and reflecting, and is detached sea surface from atmosphere and prevents, on the one hand, to affecting of wind to water surface and formation of surge wave, and, on the other pumping over of energy from the heated water to air.

The following aspect consists in that said collapsible pontoon of cellular structure, wherein upper surface of said upper web has high absorbing and high heat-conducting surface, comprising heat-isolating substrate. This allows creating a heated surface of large area.

The following aspect consists in that said collapsible pontoon of cellular structure, wherein the upper web has high heat-conductivity and reflection, and main web located from below and forming chambers that can be filled with cold water by external source, for example, as artificial upwelling water pump stations (Dunn S., Kirke B., Feldman B. et al US 20070270057, Kithil P. W. US 20080175728). Such device allows to reserve said cold water sufficient time interval, not fearing that more heavy water will drown. This also allows reducing a quantity of water pumps that are necessary for creating a cold water surface layer for protection against hurricane.

The nineteenth aspect consists in that it is offered two methods of said collapsible pontoon installation. The first method offers to use an underwater conveyor, the second method offers dropping said collapsible pontoon, that is in collapsed state, into sea water surface.

The following aspect consists in that offered design comprising two sleeves (or row of chambers) connected to each other by impermeable web allows for dams or quick-installable barriers repairing. The feature of this design is the preliminary setting of piles, dropped down from a helicopter, partitioning off a stream by palisade. Such palisade does not almost cause resistance of water and is a support for following dropping down said repair means that is in the collapsed state. Said repair means being in the collapsed state arrives bottom and subsequent filling one of said sleeves with air unfolds said web upwards from the side of water stream leaning against said palisade. This web includes facilities impedimental its displacing round piles.

The twenty-first aspect consists in that said collapsible pontoons comprise lower web that together with main web forms a plurality of chambers filled with water and so that weight of this water would suffice for compensation of the possible falling of atmospheric pressure above said collapsible barriers.

The twenty-third aspect consists in creation of active means for weakening shock wave. Concerted explosion(s) of a plurality of electrohydraulic shock wave generators mounted on the way of shock wave in the places of the sharpest change of bottom relief allows to decline said bottom shock wave upwards, compelling though part of said wave to go out in air and to lose part of wave energy during this transition and its moving on air. A number of underwater sensors allow detecting the time moment of effective explosion(s). Electrical power station can provided with energy these generators. This effect can be used at depths of tens of meters and especially in places similar the Nankai Trough.

The offered designs are sufficiently simple, cheap and allow to create the multilevel system of protecting against floods. Last forecasts about possible catastrophes in Atlantic require serious actions for protection of dangerous places of shore and low-lying areas.

The present invention allows to create:

the fast, cheap and effective the flood protective system that may be mounted when danger arises or previously, the system having at different objects of protection on the basis of the same designs, including protection of separate constructions, territories, weakening of the flooding caused surge or shock waves, the channels for water removal and rescue of people, the water basin (storage) on a way of a water flow and the patches that allows to repair small dams.

The offered barriers, placed on the ground, are largely intended for use in plane area, and long piles with the engine can be useful and in a hilly terrain.

Remark: The problem of disassembling are not examined in this application. This problem is uncritical at times unlike mounting the rapidity of which is necessary in case of danger occurring.

BRIEF DESCRIPTION OF THE DRAWING

A forth below detailed description of the present invention will follow by reference to the following drawings of specific embodiments of the invention. These drawings depict only typical embodiments of the invention and are therefore not to be considered limiting of its scope. In the drawings:

FIG. 10M_1-FIG. 10M_5 represent five embodiments of said "pontoon". FIG. 10M_1 represents said "pontoon" having only one upper thin web. FIG. 10M_2 and FIG. 10M_3 represent said "pontoon" having two webs: lower and upper webs between which a water layer is located. FIG. 10M_3 includes said upper web having a thermo isolating lower layer. The "pontoon" in FIG. 10M_4 includes cold water layer that is closed from above. The cold water layer in FIG. 10M_5 is opened from above.

DETAILED DESCRIPTION OF THE PREFERRED EMBODIMENT

Figure 1A:
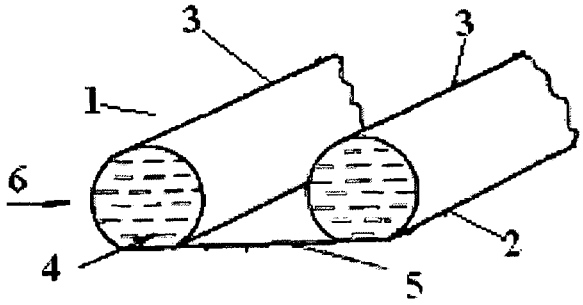
FIG. 1A (Prior Art)
FIG. 1 illustrate the according to Pat. RU 2093638 (prior art).

FIG. 1A shows one embodiment of flood protective barrier 1 according to Pat. RU 2093638. This barrier 1 comprises two sleeves 3 having a flexible envelop 2 and connected between themselves by a web 5. Each of said sleeves is filled with a filler 4 (by water, a ground, a sand or their mix). It is known many types of material that can be used as said flexible envelop (on the base of polypropylene, polyethylene etc.)

Figure 1B:
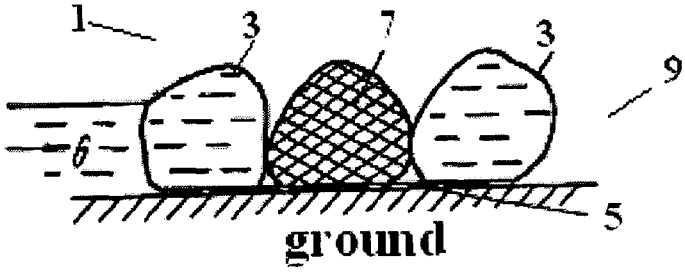
FIG. 1B (Prior Art)

FIG. 1B represents a ballast 7 (stones, ground, sand and sandbags, concrete blocks etc) that is located between said sleeves 3 on the web 5 that is placed on the ground. Said barrier 1 is located in the path of flooding 6 and protects area 9. Ballast 7 presses said web 5 to the ground, interferes with a water filtration between the web 5 and the ground, interferes with sliding the barrier 1 under the flooding action 6 and supports a distance between sleeves 3.

Figure 1C:
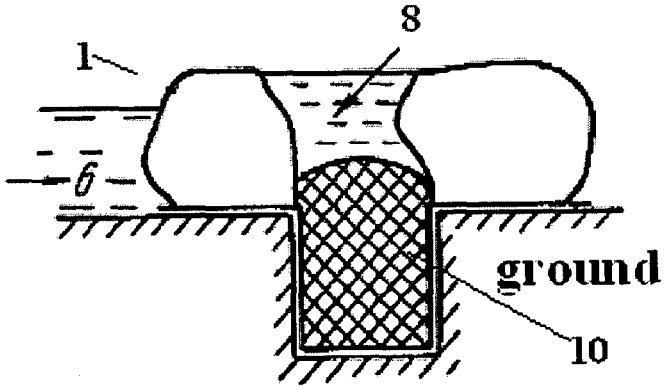
FIG. 1C (Prior Art)

FIG. 1C shows that it can be used a ballast 10 and additional water ballast 8 together. The ballast 10 is placed in spacing between said sleeves 3. A level of water 8 can exceeds a flood level.

Figure 2A:
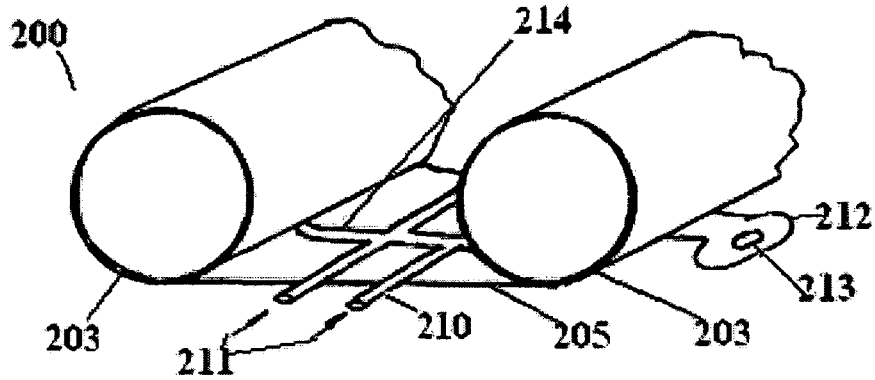
FIG. 2A-FIG. 2C illustrate various spreaders that are used in the present invention.
Figure 2B:
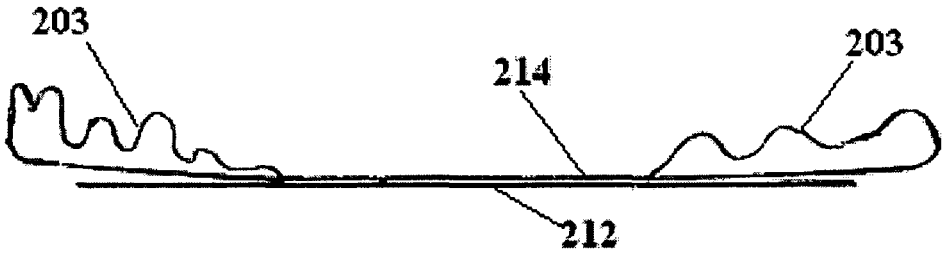
Figure 2C:
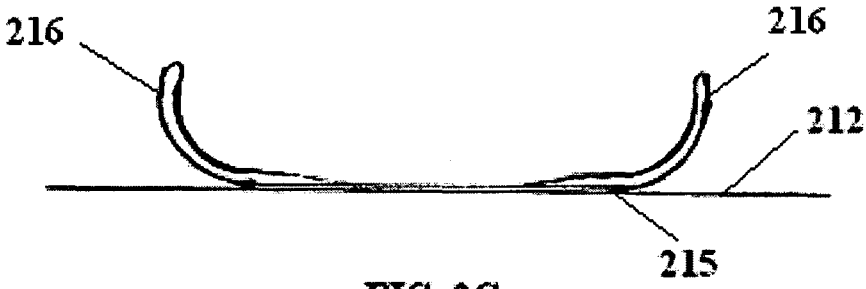

FIG. 2A illustrates the protective collapsible pontoon_200 in the working state according to present application. Two sleeves 203 having impermeable flexible envelops and the web 205 connected them are shown. They may be made from plastic, composite and the like. FIGS. 2A-2C show said forming means, including the rigid spreader 212 or the tube-like spreaders 210 and 214 that are filled with water through branch pipes 211 that are connected to pump subsystem (it isn't shown). The diameter of sleeves and width of a web (or distance between sleeves) are chosen with regard to a real ground relief and a flooding wave forecasting. Said sleeves are closed from two ends (it isn't shown). The diameters of these sleeves are not necessarily equal.

The diameter of at least first sleeve 203 (front sleeve that is the nearest to flood water) is chosen within allowable limits according to the expected height of flooding, and distance between sleeves on the basis of an estimation of flooding height, possible shock loading and real (established by practical consideration) factor of filling of space between sleeves. Said web is fastened to these sleeves by glue, welding and the like. The width of said web 205 in direction that is perpendicularly to said front depends of predetermined flood water height, possible weight of said ballast, properties of ground surface and lower web surface.

On the web 205 two longitudinal pipes 210 and flexible pipes-ribs 214 are fixed. The cross tubes 214 stretch the envelop 203, releasing a space for loading with ballast.

FIGS. 2A-2C represent the rigid spreader 212 having the opening 213 for fixing on the ground. The spreader 212 can have on its ends the holes 213 for its fixing on the ground by means of bolts (or steel pins) or any fixing means. Such spreader 212 together the rigid ribs 216 create free space for loading by ballast. The flexible ribs (shape-memory alloy, etc.) are erected at once as soon as said barrier installing. Said ribs in the form of filled pipes are developed gradually, but first.

Figure 2D:
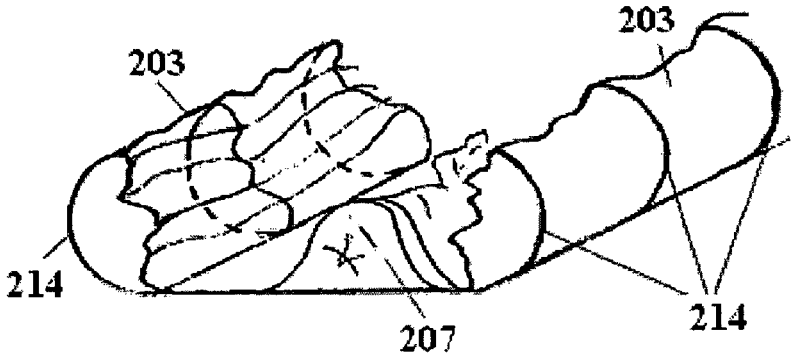
FIG. 2D-FIG. 2F illustrate various variants of ballast location.

FIG. 2D represents the offered quick-installable barrier after placing on the ground. The spreaders and ribs 214 (are not shown) also have formed the wide free space between said sleeves 203, convenient for loading with ballast 207. Those walls can constrain a flood water force. Said sleeves may comprise one or more section. Said sleeves contain correspondent number of branch pipes and valves that allow connecting all these chambers and sections in unity subsystem and connected it to pumping subsystem.

From protection said sleeves 203 for protection against sharp logs can be covered (or is made) of the strong armor material similar to Means of Individual Armor Protection, for example, high-strength composite_like (or twaron, dyneema etc). Besides this covering of the external party may be used a scaly covering consisting of plastic, ceramics, a composite or even metal, forming an armored board, use of a protective chain armour is possible (they are not shown).

Figure 2E:
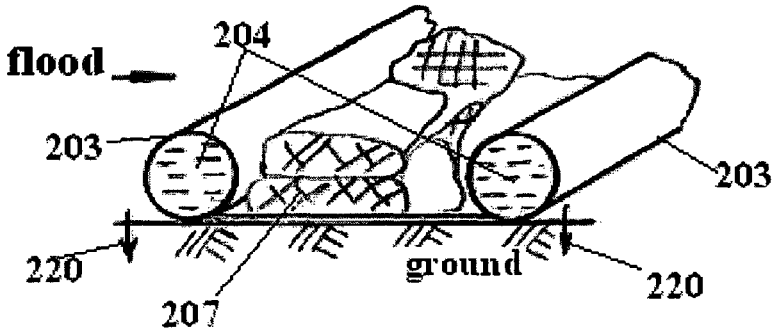
Figure 2F:
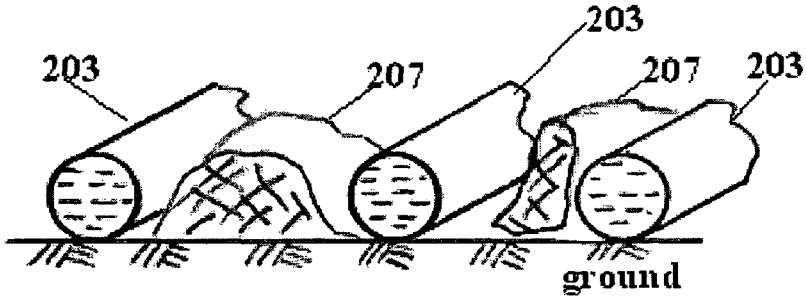

FIG. 2E and FIG. 2F illustrate an example when said spreaders or said web are fastened on the ground by an anchor bolt (or pins) 220 or like. Such fastening is especially important in an initial stage when the weight of ballast 207 is still small, and useful in the further, raising resistibility of a barrier. FIG. 2F illustrates an example of said barrier comprising three sleeves 203.

Figure 2G:
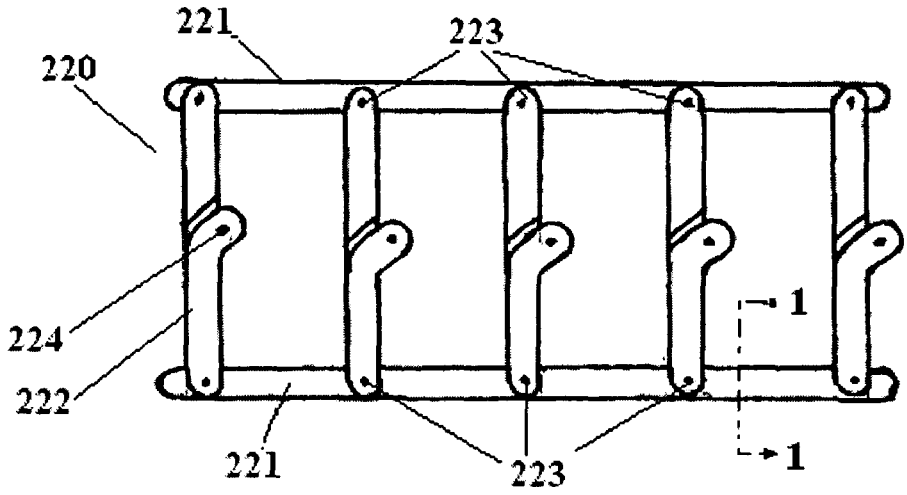
FIGS. 2G-2H illustrate said spreader in the view of "folding ladder".
Figure 2H:
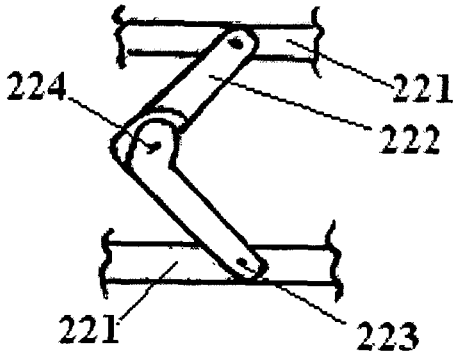
Figure 2I:
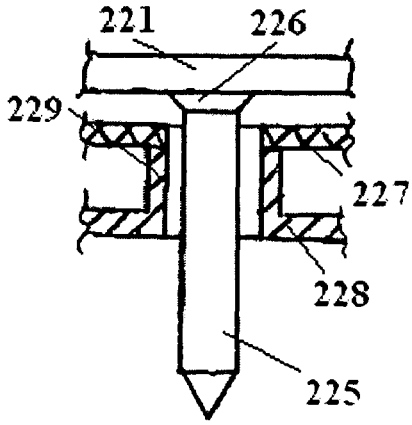
FIG. 2I illustrates a pin (a plug) for fixing said barrier and shows a sectional view taken along line 1-1 of the automatic balancing apparatus shown in FIG. 2G.

FIG. 2G and FIG. 2H show the spreader "folding ladder" 220. It includes two groups of hinges: hinges 223 and hinges with stopper 224. Two long sidepieces 221 are connected by crosspieces. Each crosspiece consists of two parts 222 that are connected one to another by hinges with stopper 224. It is shown one partially folding section of said "ladder". Such "ladder" may be used as spreader or spacer. Said "ladder" is placed on the said web 227 (FIG. 2I), in particular, between sleeves. Said sidepieces and crosspieces may be made of plastic, metal, may be tube-like or have special profile.

The web 227-8 (FIG. 2I) has an opening in the view of cringle (228) or hole having a wall 229. The steel pins 225 (or other bulges) pass through said opening (hole) and such 225 (or like) may be driven into the ground or inserted as plugs into cavities-sockets inside said anchor concrete blocks (they aren't shown). Said anchor concrete block may include various locking means for fixing said pin or said bulge. An envelop 228-9 is made from high elastic material. Said pin 225 may be fastened rigidly on the sidepiece (or further the bar) 221 or use a rotating unit 226. The rotating unit allows using a self-screwing pin. Such self-screwing pin makes available fast fixing for this design.

As forming means can be used a skeleton, several sections or groups of said sections located between said sleeves and said web. They can in the view of a rigid, geometric invariable, statically determined truss collapsible structure that is built on the base of "collapsible construction equipment", containing from bars (tubes, profiles), comprising a number of sections connected to each other. It is necessary that such structure consists of triangles formed by said bars and connected to one other in vertices. Two types are known two types of such structures: the structures of the first type comprise only triangles and are assembled from several elements (bars, triangles etc), another structures comprises folded parallelograms (see below). In second case said parallelogram is unfolded and takes the form of rectangle. The locks fixed in two vertices (c1, c2, c3, c4 FIG. 2J, 2K) of said rectangles (c3-c4-d4-d3, c3-b3-b4-c4 etc.) stiffen with said structure in this case. Said truss structures may be made from metal (aluminum, steel), plastic and carbon fiber reinforced plastic, wood construction and their combinations. Said triangles lying in the single plane form the face (front, bottom, lateral etc).

Figure 2J:
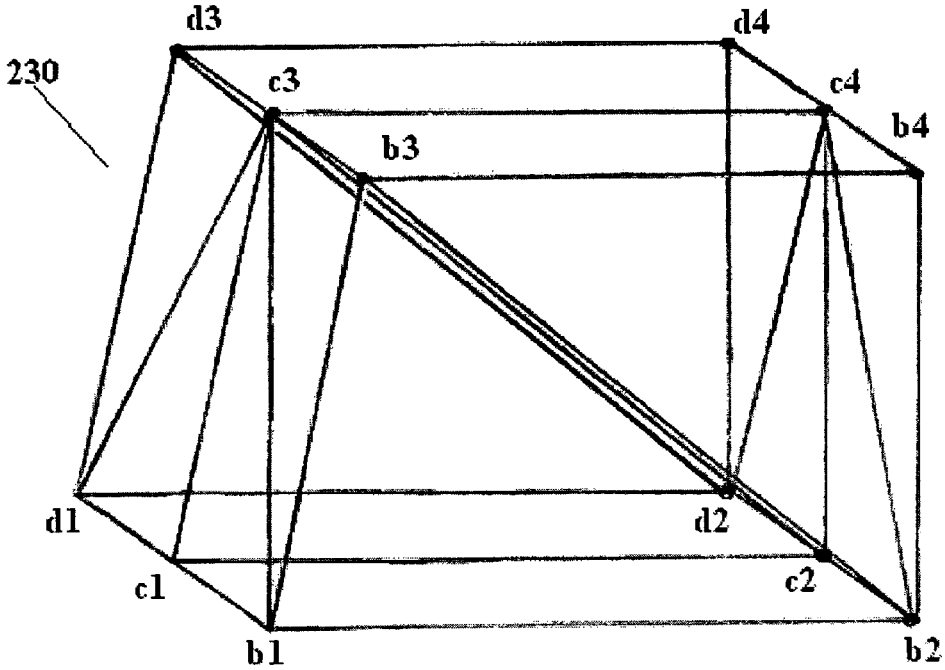
FIG. 2J-FIG. 2M show a folding fragment (truss) that may be used as spreader and its arrangement between said sleeves.
Figure 2K:
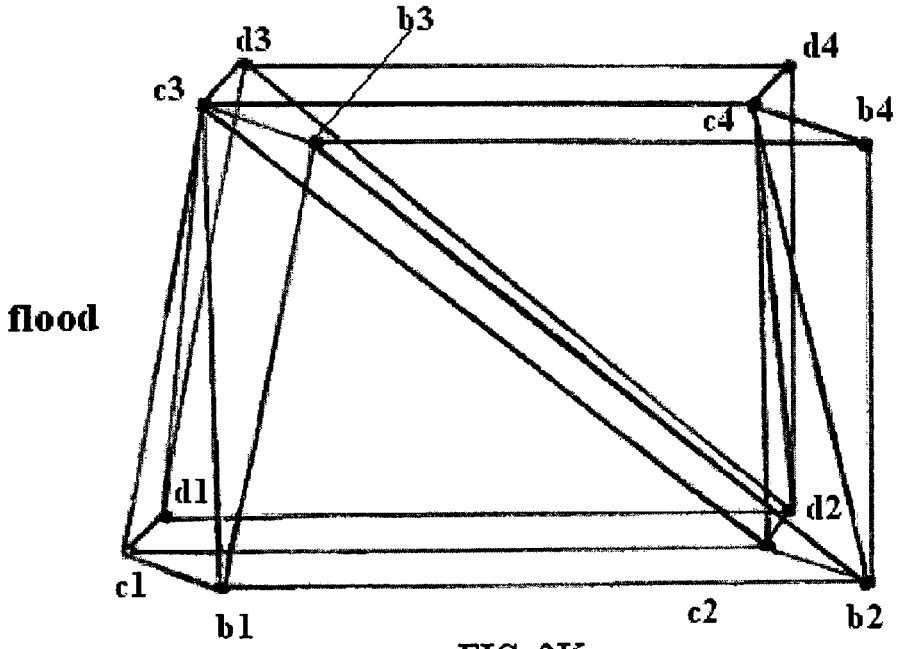

FIG. 2J and FIG. 2K represent, for example, a fragment of said folding (prefab, collapsible) truss (the truss is rigid, geometric invariable, statically determined structure) 230 consisting of rectilinear bars (rods, beams) the ends of which are hinged one to another as an example. This fragment includes two truss-cells that are formed by vertexes-hinges b1-b2-b4-b3-c1-c2-c4-c3 and c1-c2-c4-c3-d1-d2-d4-d3. Each said section consists, at least, of twelve main bars. They form lateral three faces (frames) b1-b2-b4-b3, c1-c2-c4-c3 and d1-d2-d4-d3. Each face comprises one or more triangular Each said frame is strengthened by the diagonal bars (b2-b3, c2-c3, d2-d3) that are transformed it in the triangular-formed rigid design. The frames-faces of this first pair (b1-b2-b4-b3 and c1-c2-c4-c3) are connected by cross-bars b1-c1, b2-c2, b3-c3 and b4-c4. The frames-faces of this second pair (c1-c2-c4-c3 and d1-d2-d4-d3) are connected by cross-bars c1-d1, c2-d2, c3-d3 and c4-d4. The frames-faces b1-c1-c3-b3, b2-c2-c4-b4, c1-d1-d3-c3 and c2-d2-d4-c4 are also strengthened by the diagonal bars (b1-c3, d1-c3, b2-d4 and d2-c4) that are transformed it in the triangular-formed rigid design. This diagonal bars give the constructive stiffness. Hence, said frame-face b1-c1-c3-b3 can turn as rigid planes round axe b1-b3 concerning frame-face b1-b2-b4-b3 thanks to hinges etc. Said hinges allow folding said design 230 concerning axes b1-b3, c1-c3, d1-d3, b2-b4, c2-c4 and d2-d4 as it is shown in FIG. 2K. The use of hinges-stoppers c1, c2, c3 and c4 allow affording automatic fixation of said design. Such truss may be used as spreaders that are located between said sleeves. Additional bars that can be used for additional strengthening (for example, b2-d2, b4-d4, c1-b2, c1-d2 etc) are not shown. The front face of said skeleton is formed by the frames-faces b1-c1-d1-d3-c3-b3, the back face is formed by frames-faces b2-c2-d2-d4-c4-b4.

Said barrier, wherein said skeleton consists of said separate bars, plane frames, truss-cells, collapsible truss-cells in the view of five- or more faced (hedral) trusses and said connecting means, and wherein said front face is located vertically or deflected through low angle aside protected territory; said barrier can have a back face for keeping of ballast. Said skeleton is mounted, using auxiliary components that are chosen from the group, including: bars, clips, clamps, angular elements, hinges, diagonal bars, lengthen bars, couplings, limit connectors and the like. The diagonal bars are used for formation of triangular trusses and giving of rigidity to said skeleton.

Figure 2L:
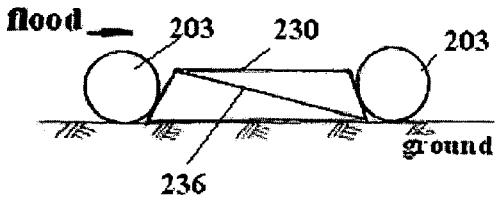
Figure 2M:
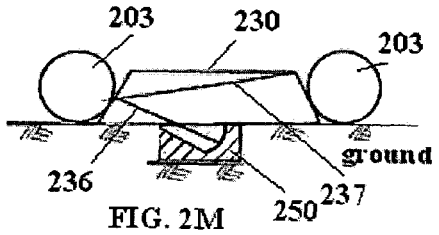
Figure 2N:
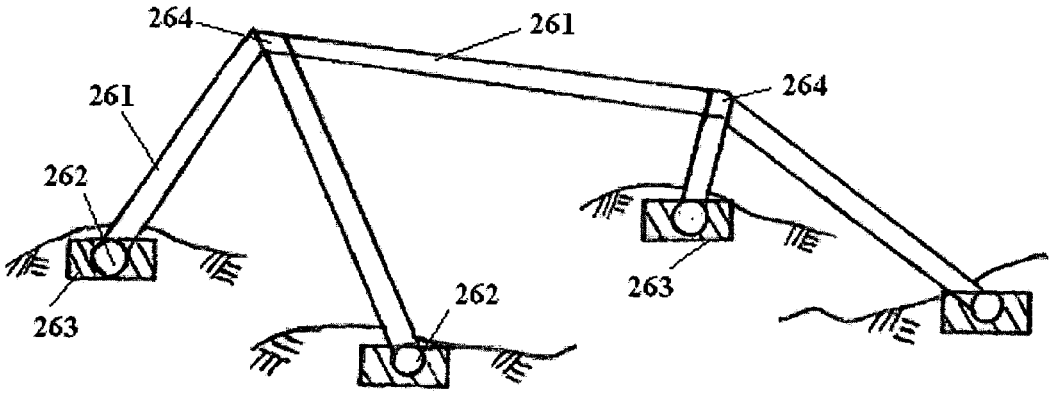
FIG. 2N shows additional means fixed to anchored blocks and supporting said flood protection barrier.

FIG. 2L and FIG. 2M illustrate schematically possibilities of using of truss 230 (as they are shown in FIG. 2K relative to flood) for strengthen of said barriers. Such trusses may be located between said sleeves 203 and distributed along barrier. The inclines of front and back bars increase stability of said barrier. The diagonal bars 236 are under compressing loading. In FIG. 2M said diagonal bars 236 rests against a supporting jack that is made in the buried concrete block 230 (each said truss includes at least two such diagonal bars). Said support ends passing through web openings (cringles) do not lead to increase water infiltration. Said ballast may be located between said trusses and inside said trusses. The separately (at the distance) located said trusses don't interfere to loading of said ballast. FIG. 2N represents additional means for flood protection. The bars 261 include hinges 262 that are placed into concrete blocks 263. Said concrete blocks 263 are fastened to ground. Other ends of said bars 261 are connected directly or additional bars to each another. The units 264 are lock units. These additional means are useful as the first line of protection.

Figure 3A:
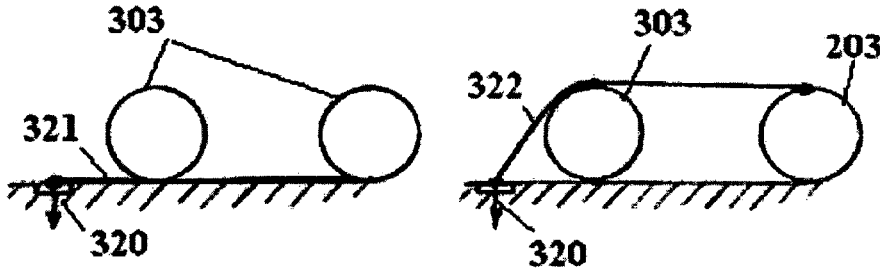
FIG. 3A-FIG. 3B illustrate anchored means and a view of a lock for said anchored means.
Figure 3B:
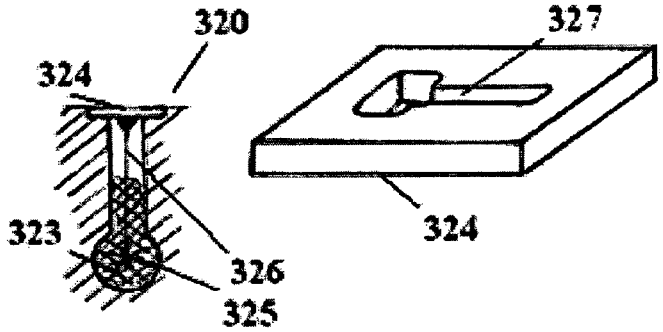

FIG. 3A represents two variants of anchored means 320 use for increasing barrier stiffness. One or two sleeves 303, spreaders (or web) 321 and/or additional ropes (cables) that are fastened to said anchored block 320. FIG. 3B shows one example of said anchor block 320. The external form and the sizes of these blocks are chosen so that they are have been enough fixed in the given ground. For example, the hole drilled (or dug) in the ground has below expansion 323. Inside of such expansion 323 there is a metal asterisk or an anchor 325. This asterisk 325 is connected by a cable 326 to a locking part 324 located on a ground surface. The hole is filled in by concrete or stones. The lock 324 comprises an aperture 327 for an external hook. The lock part can have different forms and material depending on type of the lock. It can be mechanical, magnetic or any other. Said anchor blocks are simple enough and cheap and can be in advance mounted in the predetermined dangerous places previously.

Figure 3C:
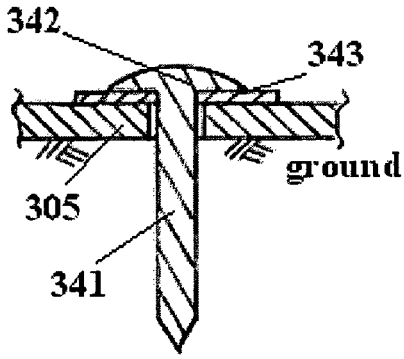
FIG. 3C illustrates an inserted rod-plug and anchor-socket.
Figures 3D, 3E:
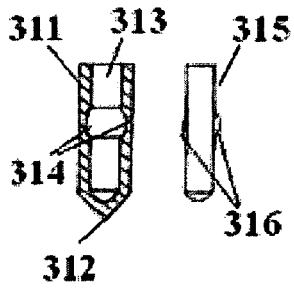
FIG. 3D-FIG. 3H illustrate using of the "zipper" together with said anchored block.

FIG. 3C represents an anchor in the form of a rod or a pin 341. Such anchor can have a head 342 for the web fastening in barrier and pressing said web to the ground. In this case the garget 343 can be attached to the said head 342 for an infiltration exception. In other application the similar anchor-stack has no head and can be attached to corresponding design from below. The rod (pin) 341 can have various extras for fastening in the earth. FIG. 3D and FIG. 3E show metallic or plastic anchor casing 311, having a sharp edge 312 and inner channel 313 for inserted pin 315. For fixing said pin 315 into channel 313 said anchor casing 313 comprises a groove 314, and said pin 315 has a spring clamp 316. It is known many different designs for fixing anchors in the ground.

The front beams 231 (FIG. 2J) can have continuation downwards in the form of said pins 315, in particular, "tie rod" (they are not shown). Such pins and anchor casing 311 allow raising stability of barrier.

Figure 3F:
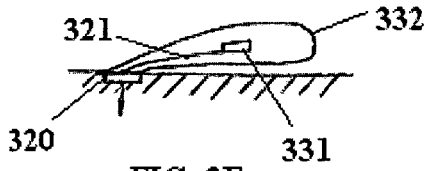
Figure 3G:
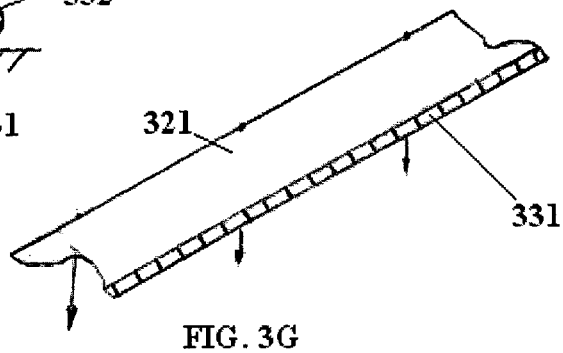
Figure 3H:
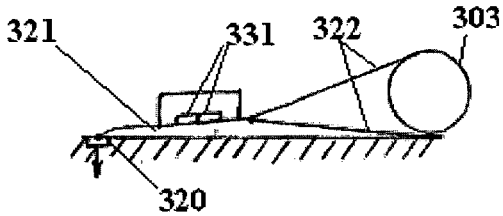

FIG. 3F, FIG. 3G and FIG. 3H illustrates use of a fastener of type "open-ended zipper" for acceleration of barrier mounting. In FIG. 3F one of anchor blocks 320 is represented. One of zipper tapes 321 including a row of zipper pins 331 is fastened to said anchor block 320. In FIG. 3F the plastic cover 332 for protection against a dust is shown also. In the collapsed state, when flood is absent, the cover 332 can be placed in a superficial layer of the ground.

FIG. 3G represents the fragment of said zipper, including the tape 321 and a mechanical part of said zipper 331. The tape 321 may include a rigid (plastic) strip that is fastened along an edge of said tape (it is not shown) for supporting the flat form of a tape. It is convenient for fastening to said anchor block and facilitates zipping.

FIG. 3H represents a cross-section of mounted barrier. The sleeve 303 is connected to zipper by cables (tapes, bands) or web 322. Both parts of said zipper (331) are connected together.

Figure 3I:
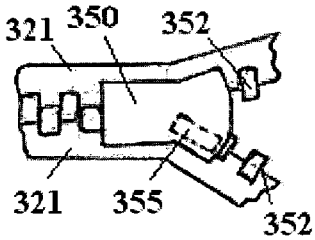
FIG. 3I shows an opportunity of the vertical column-support using.
Figure 3J:
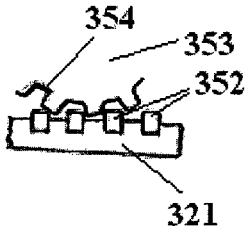
FIG. 3J shows zipper pins fastened to two zipper tapes.

FIG. 3I and FIG. 3J illustrate an automatic slider 350. The zipper pins 352 are fastened to say zipper tapes 321. Automatic slider has a driver fastened on said slider 350 (it is not shown) and connected to two drive gears. One of said drive gears 355 is shown in FIG. 3I. FIG. 3J illustrates engagement teeth 354 of the gear 353 and said zipper pins 352. This variant is oriented on manual gearing of one of "stops" (for example, the "bottom stop"—the beginning of zipper tape). At their connection the control of said spider automatically switched on, and at achievement "top stop" (the end of the zipper tape) the drive is switched off.

Figure 3K:
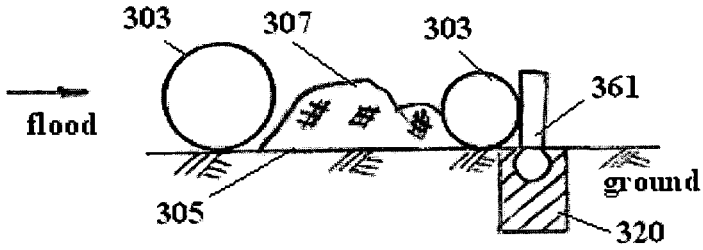
FIG. 3K illustrates an additional supporting vertical column fixed to a buried anchored block.

FIG. 3K illustrates an alternative opportunity of using said buried anchor block 320 for installation of a vertical column—support 361 that can have various cross-sections. Such vertical obstacle is widely used for blocking automobile travel. This decision is easier and faster in any dangerous situation.

FIG. 4 shows two perspective anchors that are may be used for fastening a barrier. Attempts to use similar devices for sea ships are described in the literature.

Figure 4A:
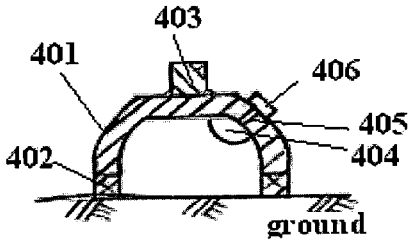
FIG. 4A represents a vacuum anchor.

FIG. 4A represents a vacuum anchor. The vacuum anchor includes a turned dome 401. Edges 402 of a dome 401, with which it leans on the ground, are made from an elastic material so that an interior of said dome has been hermetically isolated from atmosphere. Inside said dome is located an inlet 405 of an external pump 406 or a FAE (fire-air explosive) as in "vacuum bomb", burning oxygen. It is necessary to use a rigid explosive that forms a rigid oxide, as, for example, aluminum powder 404. Detonators of different type are well-known. Such anchor drives into the ground by vacuum, and it is convenient for using on a compactness ground or on such rigid covering, as asphalt.

Figure 4B:
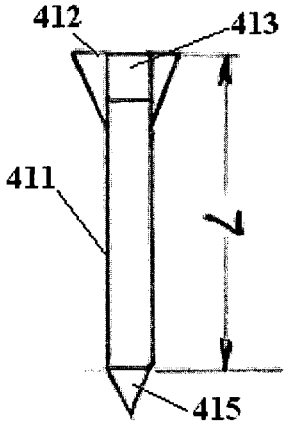
FIG. 4B-FIG. 4E represent a propellant-actuated anchor.
Figure 4C:
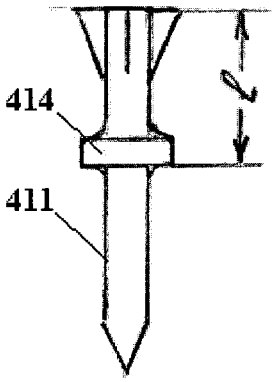

FIG. 4B and FIG. 4C represent a propellant-actuated anchor (or a pile). This anchor consists of a housing 411 having a sharp tip and the stabilizers 412. On the top (back) end of its housing 411 a rocket engine 413 is located. The housing 411 can have various facets 414, extended units or a screw bulge as self-drilling units. Diameter of this casing, its length and accessories get out from real conditions (a ground, force of influence, etc.).

Figure 4D:
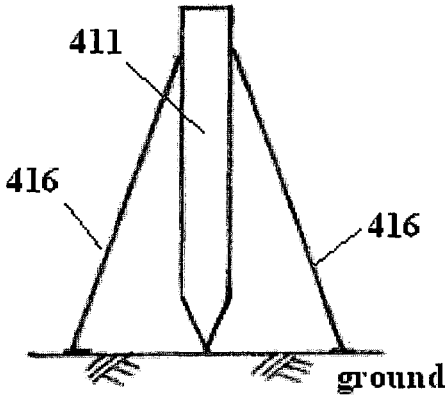
Figure 4E:
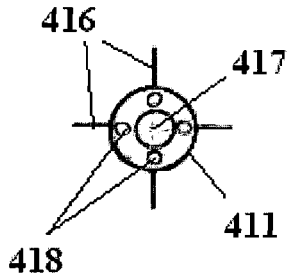

FIG. 4D provides installation of said housing 411 vertically on the ground about the help of simple props 416 for subsequent penetration of the ground. FIG. 4E shows said propellant-actuated anchor (back view). For example, the apertures 417 and 418 are apertures of a jet engine and inserting pins correspondently.

Various designs of similar anchors which allow to fix them in the ground or in walls are known many: Pat. Appl. US 20070142835 (an anchor using a pre-attached suture material). After insertion, lateral wings can be deployed on the bone anchor to prevent anchor pull-out.), Pat. Appl. US 20060245841 (Self-drilling anchor), Pat. Appl. US 20050152766 (Drive anchor) etc.

Figure 4F:
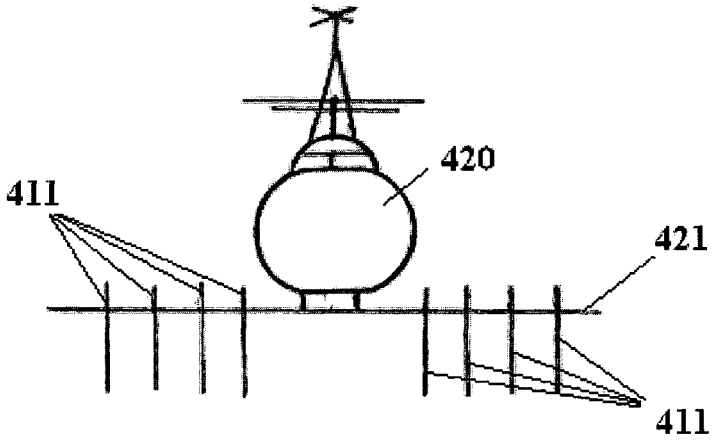
FIG. 4F illustrates an opportunity of the propellant-actuated anchor installation by means of helicopters.

FIG. 4F shows second way of using of said propellant-actuated anchor. It allows delivering quickly these anchors in remote places and to establish a lot of anchors simultaneously, that can be very important in critical situations. FIG. 4F represents one helicopter 420, equipped by a special external suspension bracket 421 on which a group of said anchor housings (or piles) 411 are fixed. It is convenient to use two helicopters type Mi-26 connected by a cross-beam (it isn't shown) as flying crane, similar to this beam. Systems of detonators and systems of exact control are known. Such anchors are convenient for using on a soft ground and at the sea or water-basin bottom as piles.

Figure 5A:
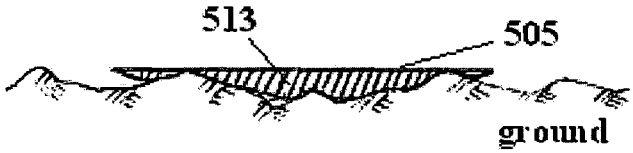
FIG. 5 shows different ways of struggle against water infiltration.

FIG. 5A shows that an easily thin extensible film pressed against the ground, located below than the lower side of said web 505 and forming a tube 513, filled with water or air, together with said web 505. Easily extensible film allows much better to press against to roughnesses of the ground and reduce a size of water filtration from below said web 505. The width of the strip 505 should be much less than width said web. This tube 513 interferes to infiltration, but too wide tube can facilitate displacement of such barrier.

Moreover, means for decreasing of infiltration may by chosen from following group, including: hydrophobic wool 520 (FIG. 5B), hydrophobic or/and gecko-adhesive covering of the lower side of said web 505 or combinations thereof.

Figure 5B:
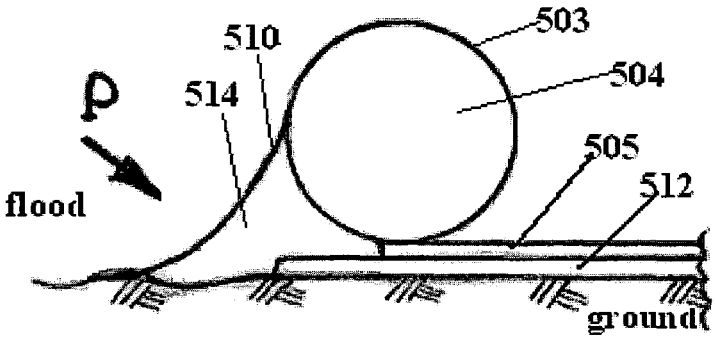
Figure 5C:
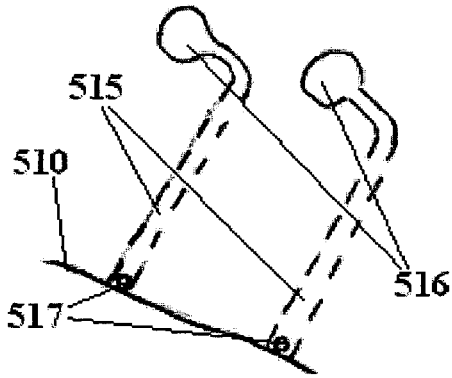
Figure 6A:
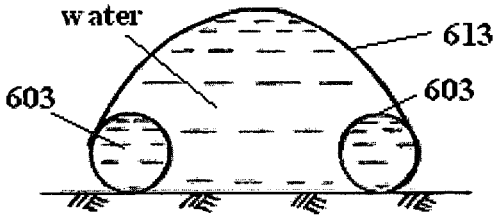
FIG. 6 shows different ways of barriers on the base of parallel sleeves using.
Figure 6B:
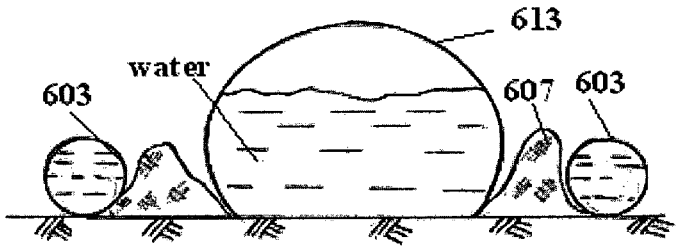
Figure 6C:
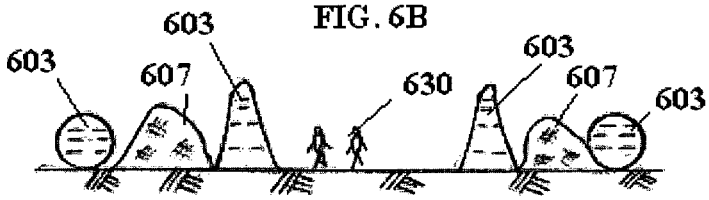
Figure 6D:
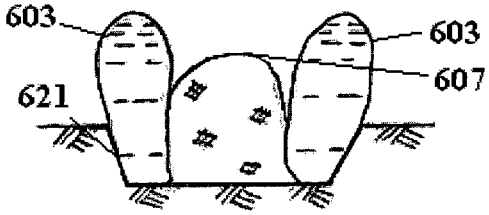

In FIG. 5B and FIG. 5C a protective skirt 510 for struggle against water infiltration under said barrier is shown. This skirt 510 represents a strip of the thin impenetrable flexible easily extensible film fixed on a front surface of a front sleeve 503 and the bottom surface of the web 505 along said web and so, that it forms the cavity 514, having in section a triangle with the curvilinear parties. This cavity is located along said front sleeve and in parallel to it. In the FIG. 5C said spreader 512 is shown. The cavity 514 is connected to the pump subsystem and has to be filled before said sleeve 503 only for said skirt is smoothed out in contrast with U.S. Pat. No. 6,126,362, wherein similar cavity is pumped out. In our embodiment ballast holds said barrier on the place. The size of said skirt in the flood direction is very little by comparison with similar size of barrier, and said skirt don't have an effect upon said barrier position. The water pressure P passes through water 514 to the lower part of said skirt and reduces infiltration.

FIG. 6 shows different variants of the barrier systems on the basis of the present invention. FIG. 6A represents a design in which the web 613 forms a tube-like channel, and main sleeves 603 are located inside of said tube-like web 613. This channel may be used for transferring water from any source (for example, accumulator). The weight of this water is additional ballast, and this design allows increasing size of ballast essentially in comparison with known. FIG. 6B represents more reliable design than the previous figure. Said web 613 is strengthen by ballast 607. FIG. 6C represents a double barrier which allows to create the protected way 630 for evacuation of people and different the equipment. FIG. 6D illustrates an opportunity said barrier mounting in preliminary made trench 621 and may be used as a wall of a water storage-trap. Said artificial water storage allows using fresh water that is accumulated in said water storage at flooding.

Figure 7A:
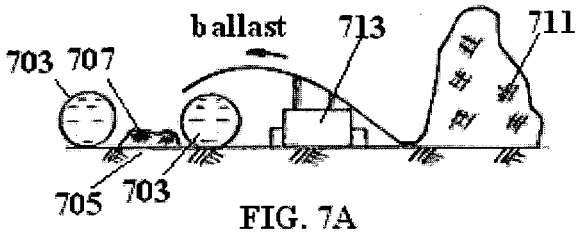
FIG. 7 shows different ways of ballast loading using modern earthmoving machinery and dredgers.
Figure 7B:
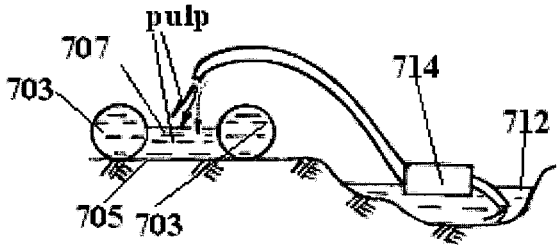
Figure 7C:
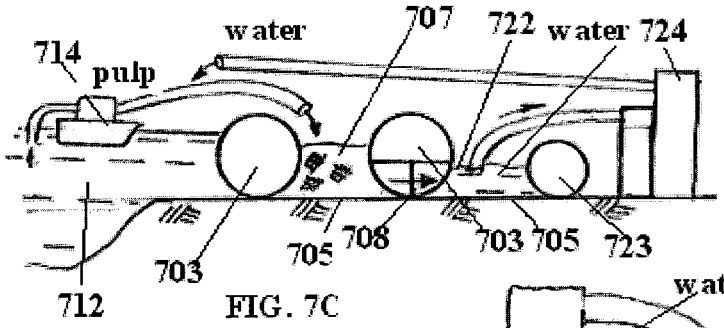
Figure 7D:
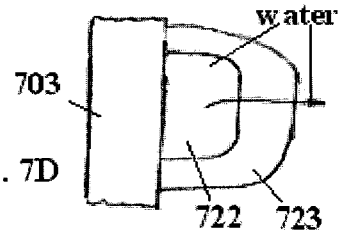

FIG. 7A shows that conveyor 713 may be used for acceleration said ballast loading from local storage 711 by mounting said barrier system on the base of EB, comprising two sleeves 703 connected by said web 705. FIG. 7B and FIG. 7C show that pulp also may be used as a ballast. A dredge 714 pumps out said pulp from a reservoir 712 into space 707 between said sleeves 703 and pumps up said pulp into space 712 between sleeves 703. FIG. 7C shows that a third sleeve may be useful. The third sleeve bounds an area near the back (second) sleeve 703 so that the bottom of said area is covered by the web 705. The back sleeve 703 has an aperture 708 that connects the space between sleeves 703 and third sleeve. This aperture is closed by filter that passes only water. The pump 724 transfers said water from said area to said reservoir 712 back. Such process allows increasing density of ballast in the space between main sleeves 703. FIG. 7D shows that said apertures 708 may be located at distance.

Figure 8A:
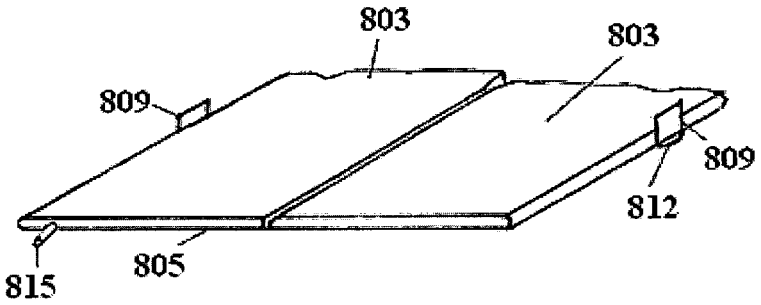
FIG. 8 shows barriers folded in the form of package and suspended from the vehicle conveyor.
Figure 8B:
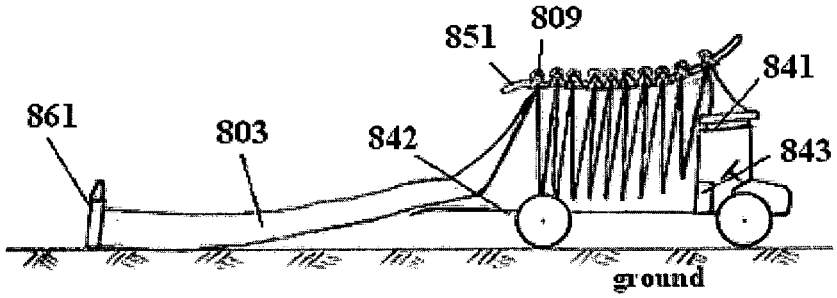

FIG. 8 illustrates as a transport 841 allows accelerating the quick-installable barrier installation. The fragment of the said barrier with the empty sleeves 803 connected by said web 805 is shown in FIG. 8A. It is shown also spreader 812 and the connecting pipeline 815. Sliding elements 809 are used for installation collapsed barrier on the overhead conveyor. FIG.

8B represents transport 841 having a platform 842. Said sliding elements 809 are placed on the rigid guide rails 851 (it is minimum two guides), and the whole barrier, consisting of sleeves 803, is assembled in an accordion package and placed on the conveyor 851 by the means of said sliding elements 809. For installation on a place one of the barrier ends is fixed and joins to a pump subsystem 861, and then will unfold at movement of transport 841.

In the wake of said transport 841 between said two sleeves the roller (is not shown) can move, press said web to the ground and even can be supplied by the equipment for driving said pin-nails (FIG. 3C) into the ground. Said heads can be in advance generated or to be formed at driving. Said pins can be hammered directly through a material or through preliminary made apertures fixed by cringles.

Figure 9A:
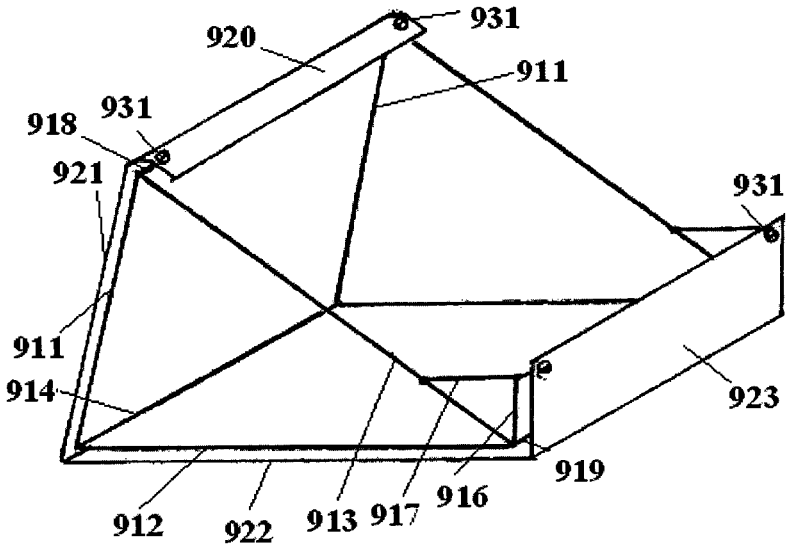
FIG. 9 represents a barrier on the base of "collapsible construction equipment".

FIG. 9A illustrates a fragment (or section) of a skeleton of more simple surrounding house the mobile barrier that is convenient for house protection. This barrier is based on the skeleton that is a set of consistently connected section-trusses established on the ground around of protected object. Certain bars belonging to truss-structure are shown. These bars may be made from aluminum, steel, plastic (reinforced plastic with carbon fiber). Two bars 911, the bar 914 and the bar 918 form the front face, two bars 912, the bar 914 and the bar 919 form the bottom face of one of said section-trusses. The bar 913 is diagonal supporting bar. Bars 916, 917 and 916 are additional and are used for the back face forming. Other bars are not shown. One of complete design of truss-cell is shown in FIG. 2J-2K before. Said skeleton can be assembled from said bars with the help of connecting elements, from preliminary made combinations of said bars, from folded sections as like FIG. 2J-2K etc. The impermeable web 920 covers said skeleton forming a front panel 921, a bottom panel 922 and a back panel 923 (correspondently the first part, the second part and the third part of said web) and is fastened by clamps (or other elements) 931. This web is covered fully said barrier against flooding. It is useful to use a preliminary cut out a pattern. Corresponding edges of a pattern can be connected by buttons, glue, hook-and-loop fasteners, zipper. If necessary the pattern can be expanded by additional pieces of a material. It is supposed that an installation site of barriers and roughness of a surface of the ground surface are known in advance. Usually such designs ("collapsible construction equipment") are calculated on 2500-4000 kN/sq·m with a sufficient stock that corresponds to flooding height of 0.5-0.8 meters. Practically it is enough in many cases. Corresponding choice of the bar diameter and its thickness allows to provide confident protection of houses at higher water level. The similar design of a barrier demands to use said steel pins (FIG. 3C). These pins are fastened to said bottom bars or are continuations of said bars 911, 916. They are cut or struck (driven in) into the ground surface or fixed into anchored buried blocks to exclude barrier displacement under shifting action of water flow. This skeleton can be gathered from separate bars, can use already ready frames or the sells collected by means of connecting means (bars, clips, clamps, angular elements, hinges, diagonal bars, lengthen bars, couplings, limit connectors and the like) for assemblage acceleration.

Figure 9B:
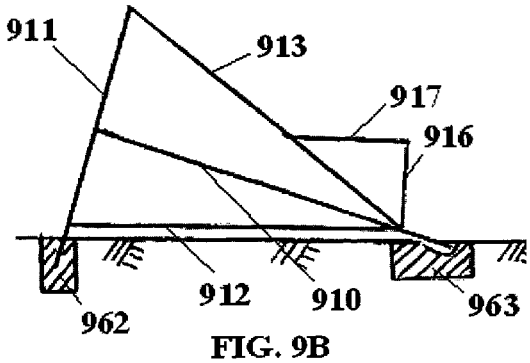

FIG. 9B shows a schema of said bars' using. The front faces based on the bars 911 and other take over flood water pressure through holes that are made in said web. The bars of 910 and 913 type work in compression and take over said pressure and use supporting anchors 963. It is shown said anchor in the view of buried concrete block 963. The anchor 962 and anchor 963 may be made in the view of dowel-block.

Figure 9C:
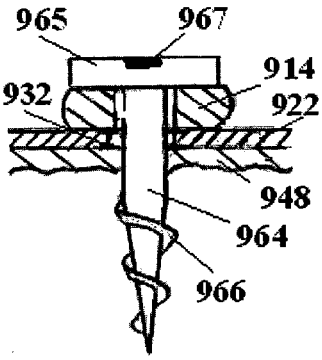

FIG. 9C shows said fixing means in the view of bore or screw 964, 966. The bores, screws and fastening to buried concrete blocks allows fixing in all direction. This bore has a head 965 and a slot 967 for a screwdriver having a long axial shaft (it isn't shown). Said head 965 rests against said bar 914. This screw 964 passes through opening in said bar, further through opening in web 922 (second strip) that is framed by a cringle. Between said web and the ground a layer of hydrophobic wool 948 or any means for weakening infiltration. Fixing means as like metallic pins allows fixing skeleton only in horizontal direction.

Figure 9D:
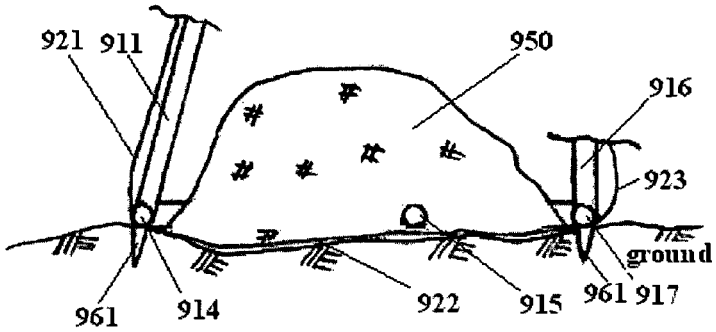
Figure 9E:
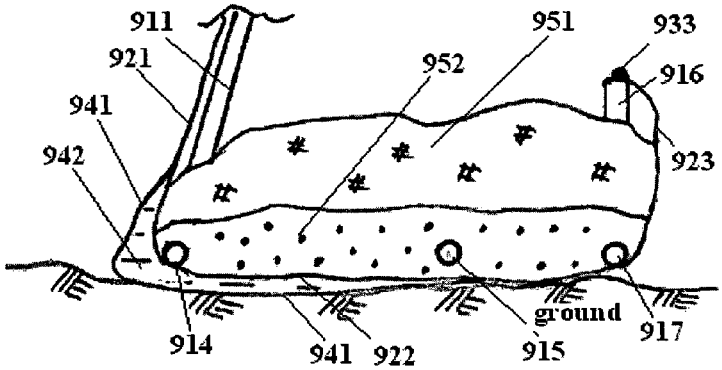

FIG. 9D illustrates a fragment of cross-section of said simple barrier. Said bars 911, 914, 916 and 917 are shown. A bar 915 is an example of diagonal bar. The web 921, 922 and 923 cover said skeleton. Simple anchors in the view of steel pins 961 are fastened to the bottom faces, directed downwards for inserting into the ground and made in the form of simple extended point. Said second part 922 of web lies on the ground pressed to ground by ballast 950. Anchors 961 in the form of simple steel pins keep this barrier in a horizontal direction The embodiment shown in FIG. 9D limits an opportunity of fast loading said ballast. Dimensional rigid blocks or metal constructions, being put on bars, interfere with pressing of said web to the ground. FIG. 9E proposes to use two layers of ballast: lower layer—sand 952 or analogous material, upper layer—the rest of ballast 951. In this FIG. is shown one of a plurality of chambers 942. The lower part of its envelop 941 is high elastic thin film. These chambers 942 are filled with water (or air) for reducing infiltration and their width is less than said width of second web strip 922 in order to don't reduce the resistance against flood.

Figure 9F:
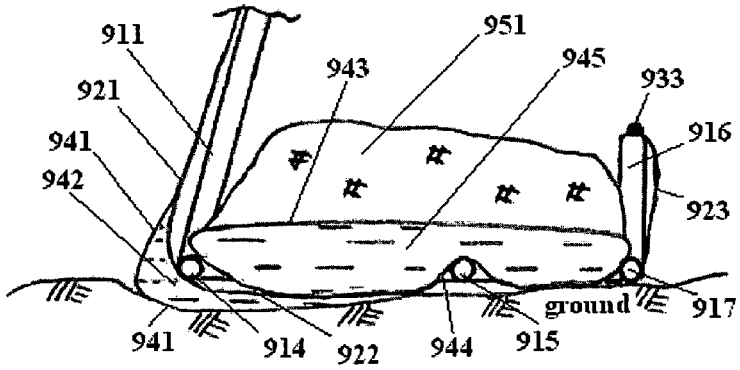
Figures 9G, 9H:
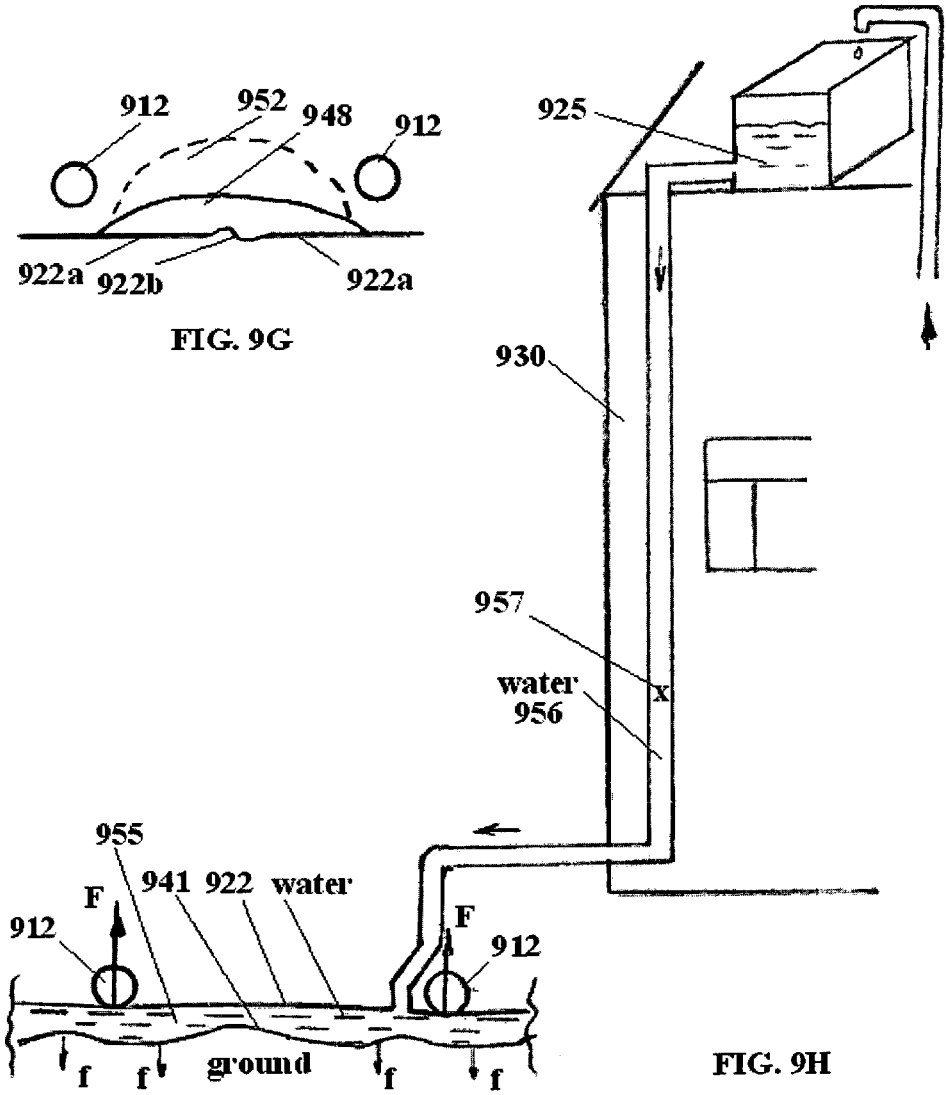

FIG. 9F proposes to use the second group of the chambers 945 filled with water instead sand. Said chambers have also high elastic thin film 943. The fixing means aren't shown in FIGS. 9E and 9F. FIG. 9G shows a fragment of bottom lateral bars 912 and the second strip 922 placement. It is shown that said second strip contains from several sections connecting bendable places 922*b* for folding. Each of these sections 922*a* is reinforced by rigid rods (bands) placed along said web so that their ends are aligned with said bends 922*b*, and said bends are placed between next bottom bars 912. Said web may be made from separate fragments that may be connected to one other by glue, hydrophobic, hook-and-loop fasteners, etc in the course of mounting. One of chambers 948 intended for filling with water is shown. Said ballast 952 is placed from above said chamber.

FIG. 9H represents a fragment of said SB. Two lateral bottom bars 912 and the second strip 922 of said web are shown. Between this strip 922 and the ground is located a sleeve 955. A thin flexible film 941 is at least a lower part of said sleeve's envelop. A top part is either the same film with one's back (or attached) to said strip 922 or, directly, the strip 922. The lower surface of said envelop 941 may be further covered with hydrophobic material or hydrophobic wool (not shown). Said sleeve 955 is placed along said second strip 922, surrounds said protected object and is intended for filling with water immediately after said skeleton and said web mounting. An interior of the sleeves 955 connected through pipes 956 and valve 957 to a water storing chamber 925 that is placed at a height over said SB. A majority of the protected objects have houses or trees so that said chamber 925 can be raised to a height up 4 meters or more. Such embodiment of SB can be successfully used if said SB includes said fixing means for fastening said barrier to the ground, for example, bores, screws, clamps and locked for attachment to preliminary buried concrete blocks (not shown), and the material of said strip 922 is low-stretched, bendable, for example, reinforced so that ends of rigid rods (bands) are aligned with bends. The process of installing such barrier comprises following steps: 1) placing said web at pre-determined site on the ground surface, 2) assembling said skeleton and its installation, 3) fixing the skeleton on the ground, 4) attachment said web to the skeleton, 5) opening tap 957. Since then, the water fills said sleeve 955. The height of said chamber 925 defines the water pressure that presses (by forces F) said web strip 922 to bottom bars 912 etc, which belong to skeleton affixed to the ground. This pressure of water presses (by forces f) lower surface of the film 941 to the ground's surface, preventing infiltration. This allows to prepare such barrier quickly, during to a few tens of minutes only, before loading ballast. Following ballast loading only further strengthens this barrier. If the ground surface is rough, then said skeleton can stepped and said sleeve 955 can consist of a few chambers, each of which corresponds to the certain range of heights and is connected to the store chamber 925 by a separate pipe with a valve.

Figure 10A:
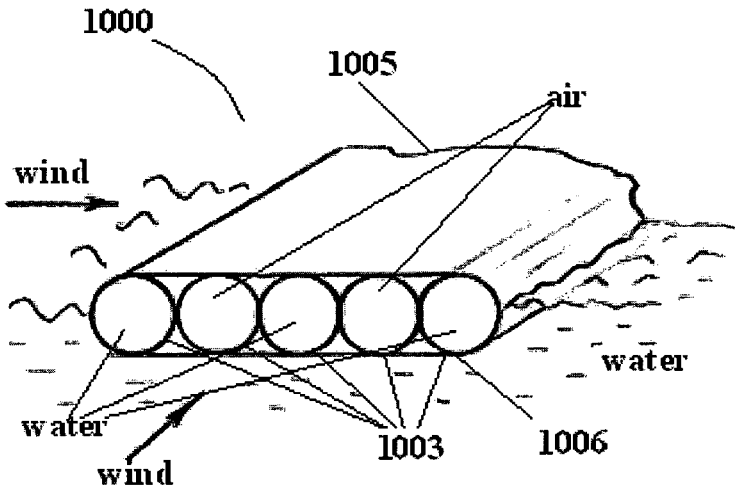
FIG. 10A-FIG. 10B represent a floating collapsible pontoon separating wind flow from water surface.

FIG. 10A represents a collapsible pontoon for "weakening "surge wind-induced" waves. Said DB is based on the pontoon 1000. The pontoon 1000 comprises two groups of sleeve 1003. One group (air) is filled with air and creates the necessary force which is pushing said pontoon 1000 out sea water, the second group (water) sleeves is filled with water and creates necessary heavy ballast that is compensated the elevating force created by wind, moving along the web 1005, or falling atmospheric pressure. This web 1005 is located on the top surface of said pontoon 1000 and connects said sleeves 1003. The top surface of said web 1005 is carried out as much as possible slippery and hydrophobic to reduce influence of wind and to facilitate rolling downhill of water. The additional lower web 1006, connecting said sleeves from below, is one of said forming means. Water will be inevitable to get on top pontoon surface at strong wind. It is known various means that are make the surface more slippery, for example, polyacrilate.

Figure 10B:
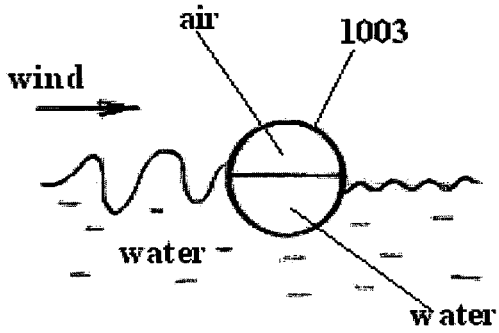

The sleeves of the first and second groups can be placed in parallel and closely, as shown in FIG. 10A, or they can be moved apart on some distance. If the water filled sleeves are located perpendicularly to waves, then an additional useful effect "breakwater" shows up. The height of waves after such breakwater essentially is less, than it was before said breakwater in the face of wind (FIG. 10B). Such breakwater may be made in the view of a sleeve 1003 comprising at least two sections: one section that is filled with air, and second section that is filled with water. The sleeves 1003 of the first and second groups can be placed and perpendicularly to one other. Moreover, the sleeves filled by air can have expansions-chambers which form cambers (hills) on the top surface for removal of water.

Figure 10C:
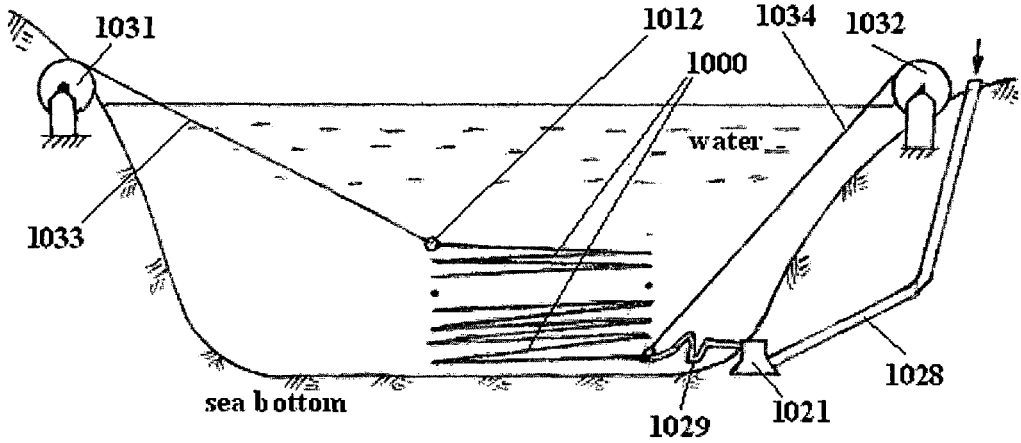
FIG. 10C-FIG. 10D are top views of said "pontoon" located in a river outlet.
Figure 10D:
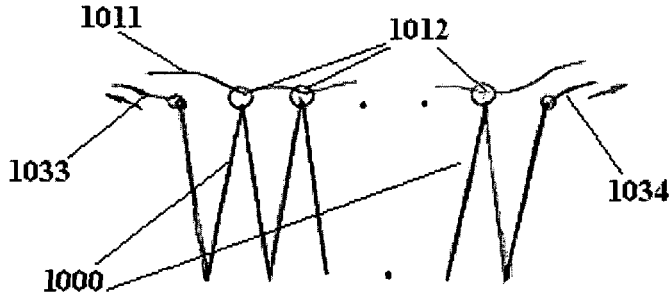

FIG. 10C and FIG. 10D show an accommodation of the pontoon 1000 that is folded in the view of a package and is located on the sea near to coast or on the contrary the mouth of the river. The winches 1031 can be located on opposite riversides and keep said pontoon 1000 on a place by means of cables 1033 and 1034. The guide 1011 and sliding elements 1012 are shown in FIG. 10D. The cables 1034 are stretched by said winches 1031 that are fixed on a sea level and try to stretch said pontoon, providing its shape. These winches may be located on the ground, on the top of special columns or on towboats (it isn't shown). Said pontoon may be in the working state during to several days only, and expenses are almost insignificant. This collapsible pontoon may be protected by the group of breakwaters which can be placed before said collapsible pontoon (it isn't shown). Such breakwater allows weakening wind-induced waves.

Figure 10E:
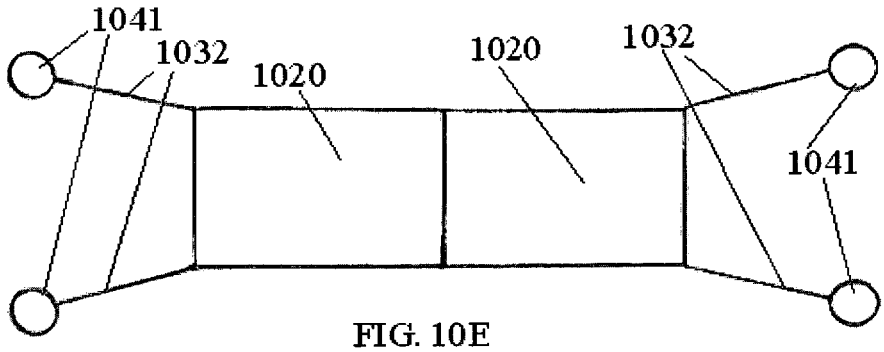
FIG. 10E represents a top view of collapsible pontoon (fragment) that is extended by three towboats.

FIG. 10E represents schematically the second variant of said "pontoon" comprising a set of said collapsible pontoon 1020 (in FIG. 10E only two collapsible pontoons are shown) that are connected to one another in working state. Said "pontoon" is extended by four unmanned towboats 1041 connected to said pontoon by cables 1032. The towboats 1041 are extended this structure in different directions by cables 1032. These towboats must only equalize local water current. These pontoons can be anchored (it isn't shown). The similar variant supposes that said collapsible pontoon, being in the collapsed state, and said towboat can be dropping from air ship (helicopters or dirigible-hybrids) directly in water or deliver by sea ship. This variant is intended for use when: 1) the destination point isn't known in advance, and it is defined on the basis of the current information on an environment, 2) surrounding coasts are not suitable for installation, 3) the large deep.

Figure 10F:
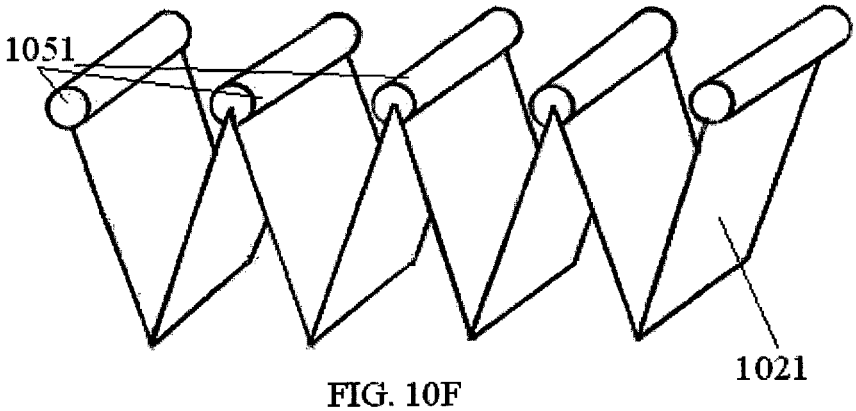
FIG. 10F represents a collapsed state of said "pontoon".

FIG. 10F shows schematically said collapsible pontoon after its dropping. Said collapsible pontoon collapsed package is unfolded (one step the process of transforming from collapsed state to working state). The sleeves 1051 (or similarly located chambers, or sleeves that are located otherwise, or balls) comprise automatic units connected to the cylinders filled with compresses air (or gas) that fill said sleeves with air automatically at immersing said DB in water (they aren't shown). Similar devices are widely known (for example in life jackets). Advancing filling of said sleeves 1051 provides necessary orientation collapsible pontoon so that collapsible pontoon would be directed upwards. Then other sleeves are filled. Compressing pumps (it isn't shown) connected to energy sources (oil, fuel-cells and the like) or/and said cylinders can be used. In the working state said sleeves must be pressurized. The in-float docking of two unmarred floating bodies may be executed using the experience of the two (one a tanker, one a receiver) unmanned aerial vehicles (UAVs).

Figure 10G:
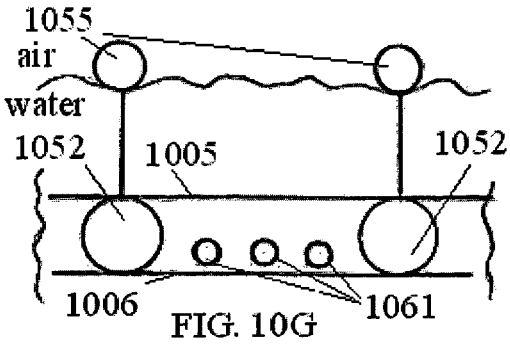
FIG. 10G-FIG. 10K represent the pontoon having cellular structure and using thin-film web sections for a covering of water surface in the cells.
Figure 10H:
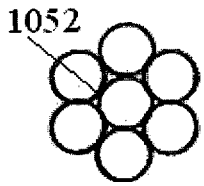

FIG. 10G represents the fragment of the cross-section of said barrier that is located underwater after its straightening. This barrier comprises said bundles 1052 forming circular or n-gon planar structures. These bundles 1052 comprise at least one sleeve for filling with air. Said sleeves 1051 (FIG. 10F) and sleeves (or cambers) 1055, that are filled with air, are able to hold said barrier near water surface. Said bundles 1052 can comprise a set of openings 1061 that connect interior of cell chambers located between said bundles 1052 and the upper and the lower web (1005 and 1006) to water surroundings. Said barrier comprises a control unit (it isn't shown) that allows sequentially filling: 1) said sleeves (or cambers) 1055 (or said 1051) with air for holding said barrier near water surface, 2) sleeves belonging to bundles 1052 with water, straightening said barrier and filling said interior with water through said openings 1061, and 3) sleeves belonging to bundles 1052 with air, lifting said barrier on water surface, and said openings 1061 are closed by filled said sleeve with air. FIG. 10H shows cross-section of a bundle 1052 consisting of several sleeves. Covers of sleeves are executed from tire-like material. These sleeves can be located in parallel and connected to one another by special connecting bands (or made as unified structure) or twisted for rigidity increase and the DB form maintenance.

Figure 10I:
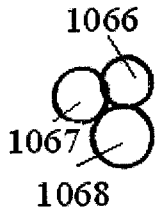
Figure 10J:
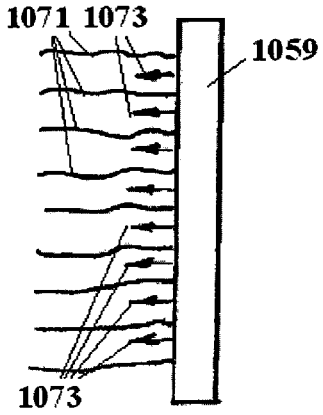

In FIG. 10I-FIG. 10J said bundle 1059 for creation of thin cod-liver oil film on the sea surface is shown. This bundle 1059 includes two, three or more sleeves 1066-68 (FIG. 10J). At least one sleeve is filled with water ballast, at least one filled with cod-liver oil as its bank and at least one—with air if this is necessary. These sleeves may be fixed alongside each other. The bundle 1059 may be fastened by anchors or by towboats (as FIG. 10E). Each bundle 1059 has a plurality of the apertures placed along its guide, these apertures are connected with said sleeve filled with cod-liver oil or the like which flow 1073 out said apertures. On FIG. 10I flexible cords (threads) 1071 which are wetted with cod-liver oil are shown. They protect a lateral surface of said cod-liver oil film from wind. It is known that the wind usually destroys film edges. The ends of cords 1071 can be connected also among themselves on sufficient removal from 1059.

Figure 10K:
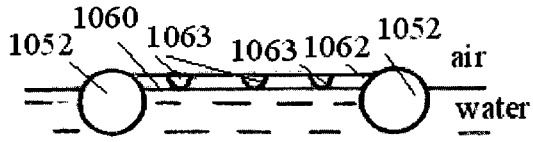

FIG. 10K shows cross-sections of said cell chambers formed by bundles 1052. The film 1062 is a simple film, a save paper or a film with air-filled bubbles 1063. This film 1062 may be placed on sea surface directly or may be parted from said surface artificially, for example, by a plurality of bubbles 1063 filled with air. Said film lies on the water surface by tops of its bubbles. Sides of these cell chambers may be made on the base of said sleeves, forming a plurality of web-fragments from said film. The edges of these web-fragments are fixed to surrounding edges of said sleeves.

Figure 10L:
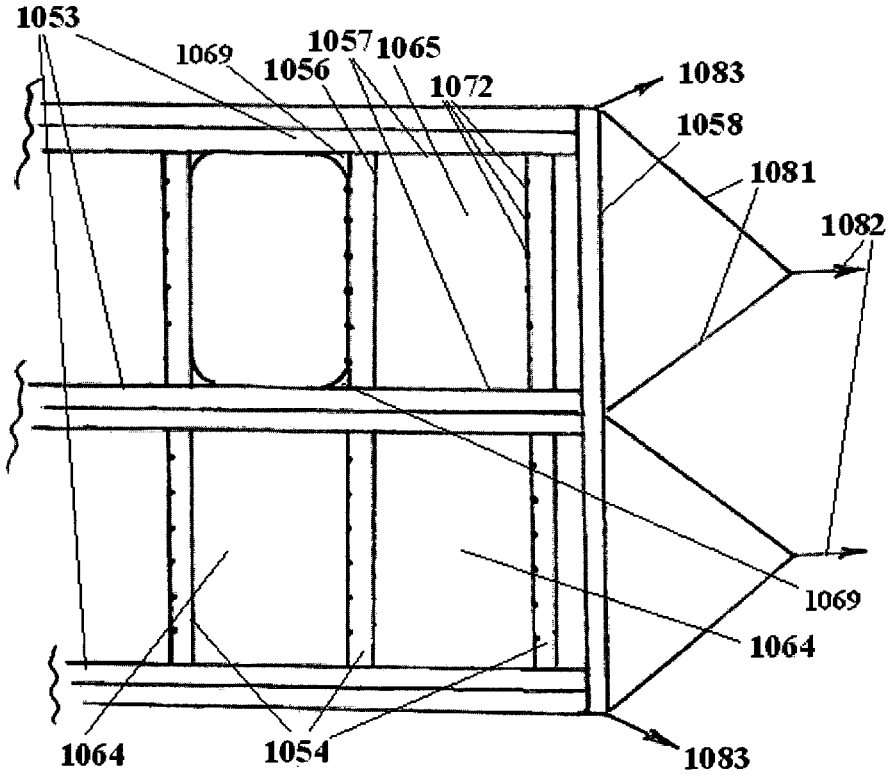
FIG. 10L shows a sectional barrier using oil-film.

In FIG. 10L a rectangular frame design of said pontoon is shown, as example. The form of cells can be various, for example, diamond-shaped or hexagonal. Each of said bundles 1053 includes one or more said sleeves, form longitudinal sides, the cross sides and spreaders are formed by bundles 1054 and 1058 correspondently. In crossing knots these bundles are connected among themselves (is not shown) and form set of cells 1064. Each such cell-window has a downwind side 1071. The lateral sides 1057 and an upwind side 1056 of each of said web-cells also are shown. Inside each said window said web-cell is fixed. Said windows may be have different form, for example, diamond.

The web-cells shown in FIG. 10L use thin-film web in the view of cod-liver oil or the like film. Very thin film web forces to form such film constantly. The points shown on a downwind side of said cell 1072 are apertures (or slots) through which arrives cod-liver oil drops. These drops spread on water surface in each cell between the said longitudinal and cross bundles. Fixed at water surface level on other sides of said web-cells (at least, on lateral sides) internal shaping oil-philic strips (the matters executed, for example, from impregnated by oil or a porous material) help to keep a film longer time. Said apertures are connected to storehouse of oil which takes places in said sleeves (is not shown). Such design allows to keep a film longer and to reduce the oil expense. The haunches 1069 (they are shown only particularly) are fragments of one of said sleeves they are filled with water, air or oil. These haunches are pressurized. These haunches and said oil-philic strips allow smoothing off all internal edge of said "windows" and curvature of oil web-cell boundary. It allows increasing the said oil web-cells stability.

Similar cells can have the sides, the sizes of which are equal to several tens meters. Drops of the oil film (fish, seal, whale fat and similar hydrophobic products are most suitable as oil, mineral oils are useless), getting on water surface, quickly spread (such drop covers a circle having radius equal to 20 meters in five minutes). The known data specifies that only 50 grams of oil suffices for creation of the oil stain having the area equal to 0.01 sq. km. The big viscosity complicates the film rupture by a blowing wind. It is known that in known cases when oil pour out in the sea, the wind destroys only edges of the oil stain. For protection of edges of stains it is offered to fix at least on lateral faces of the said windows hydrophilic strips, which will interfere with destruction of film edges, and such film will longer remain. It will reduce also the oil expense. The plastic film prevents the transmission of energy from wind to water surface, the oil film doesn't prevent this transmission, but takes up received energy from waves.

The oil drops that fall on water surface form the "thick" oil film, and then this film gradually transforms into the one-molecular layer (approximately 2 nanometers). The oil particles on draw close together when they elevate on a crest of the wave, falling-said oil film extends. Thus there is a continuous mutual friction of oil film layers, absorbing a great deal of energy. Said energy losses cause weakening of sea waves. It is known from an antiquity that after pass of the ship the oil film is broken off, and there are higher waves. Arrows 1082 and 1083 show a direction to said towboats or to winches that are located on the ground (it isn't shown).

In FIG. 10M said "pontoon" is shown by fragments of their cross-sections. The space between said bundles 1052 is covered by one, two or three webs 1005, 1006, 1007. Said webs are made from thin material (film), for example: plastic film, bubbly film, oil film. These two adjacent fragments between, correspondently: one fragment between bundles 1052*n*−1 and 1052*n*, the second—between bundles 1052*n* and 1052*n*+1 etc. Each of said fragments (FIG. 10M_2 etc.) is a "cell" that are bounded by bundles 1052 and connected by upper web 1005 and/or lower web 1006, like as a drum. Said webs are fastened to on said pontoon inside or/and outside said "cell". Said frames may include a plurality of separate "cells" that may have various sections on the sea level. FIG. 10L represents the collapsible pontoon structure having quadrangular "cells", it is probably to use hexagonal etc, and also round "cells", in which it is easier to use said twisted bundles. It is useful to use vertical form-building connectors that should be built in DB between different webs (are not shown) or the internal space of windows can be packed by a plurality of sleeves how in usual inflatable mattresses.

FIGS. 10M represent fragments of five embodiments of said "pontoon". The fragment FIG. 10M_1 is a part of lattice that is formed by bundles 1052 and is covered by the upper web 1005. This embodiment is a little practical and can be used at weak pressure difference. So in centre of "Catharina" by estimations pressure has fallen approximately to 0.1 bars and the total water ballast that can be counterbalanced, must correspond to average thickness of water layer in 1 meter.

Only following embodiments (FIG. 10M_2-FIG. 10M_5) can compensate the said pressure difference. Therefore the thickness of a water layer over the lower web 1006 (and the distance between upper web 1005 and lower web 1006) should be an order to 1 meter. The "pontoon" (FIG. 10M_2) separates a water surface from a wind and atmosphere, interfering with a thermal exchange and water evaporation. The reflecting upper web 1005 improved this counteraction. The "pontoon" (FIG. 10M_3) uses a double-layer upper web comprising an absorbing upper layer 1008 and thermo isolating lower layer 1005. Heated layer 1008 allows creating upgoing airstream having a speed about 2-3 m/sec. These structures weaken atmosphere and water surface interaction.

The "pontoons" (FIG. 10M_4 and FIG. 10M_5) allow creating and keeping the additional surface layer of cold water that is interfered to water evaporation and transmitting said evaporation energy to vortical air structures. Ways of creation such additional layer of cold water are known, but it is not known how to keep on an ocean surface this water that is heavier than warm water of the ocean surface. The water layer between web 1007 and 1006 is said ballast. The cold water layer is located over said web 1007. The embodiment FIG. 10M_4 uses the closed tank between 1005 and 1007 for cold water; the upper web 1005 should have high heat conductivity. Proposed design allows decreasing necessary cold water volume up to 0.10-0.20 m and keeping its. The embodiment FIG. 10M_5 uses the open tank (over 1007) for cold water. In both cases it is desirable, that the web 1007 was thermo isolating. One-web collapsible pontoon may be used only in the case of a little change of a atmosphere pressure.

Said water ballast chambers can be filled by pumps or can be filled automatically by through wide openings (or cuts) in the web of every chambers by submergence of said pontoon. One of said webs that is the nearest to sea water can be curvilinear cut, and a zipper tapes are fastened to opposite edges of which. This cut allows filling said internal space then corresponding window is underwater. The curvilinear cut ensures a free access for water to interior of said chambers. On one of ends of said cut the slider is set. After a hit in water (through predetermined time) said slider closes said cut by zipper. Said "pontoon" has sufficient water ballast at pressure of surrounding water. Such chambers do not require especially high impermeability, as a form is set by a skeleton that is executed from said bundles filled under pressure.

Figure 10N:
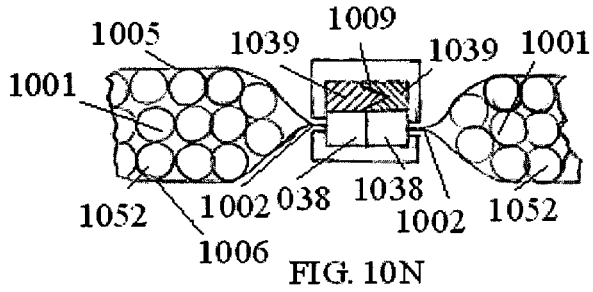
FIG. 10N shows a connection of two parts of said "pontoon" with the help of a "zipper".

FIG. 10N shows a fragment of assemble, in which two parts 1001 of said pontoon are connected through an intermediate fastener of type of "zipper". Each of said parts 1001 comprises the upper web 1005 and lower web 1006 and ends by zipper tape 1002 that envelops said bundle 1052. These tapes are connected by slider 1009. This slider consists of two parts 1038. On the top (for example) of each said part is mounted one of part 1039 of a lock. At approaching these parts are pressed to each other and are fixed in this condition by the lock.

Figure 11A:
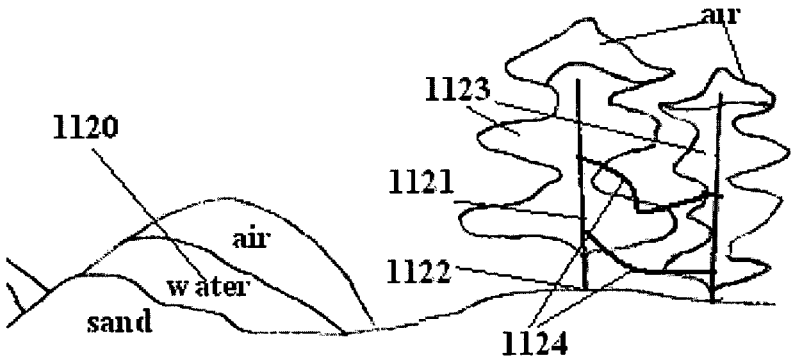
FIG. 11 shows underwater structures for weakening water stock wave.

FIG. 11A offers an artificial bottom relief 1120 comprising additional sand-water-air layers. The similar barrier is capable to weaken a little a shock wave as each transition from one medium in another is connected with energy expenses. Alongside an artificial forest is represented. It can be established on a way of said shock wave, weakening it and breaking on separate jets. Each such artificial "tree" consists from fastened 1122 on the bottom (or on the ground surface) a rigid (low elastic) rod 1121 (for example, reinforced plastic with carbon fiber and similar materials) and extended sleeves (crown) 1123 (more elastic) that may be include separate air or/and water filled sections and sections filled with sand or crushed stones. These constructions are simple and inexpensive. But they can bring serious effect. These trees can be connected with each other strong cables, forming steady "wood" which can be in due course to be replaced with mango or other similar high natural trees, in process of their long growth. These trees can be located at the bottom near to coast, protecting it, or ashore, weakening waves. Similar constructions can be used for electric power mining and decoration.

Figure 11B:
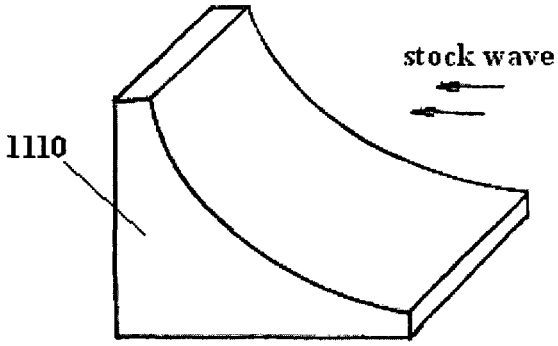

It is known that one of reasons of flooding is a shock wave that come from ocean depth and that grow near coast and in places of sharp reduction of depth. It is known, that many natural obstacles weaken influence of similar shock wave. FIG. 11B shows the figured block 1110 which can serve as the artificial obstacle on the wave way located on the sea bottom near coast. Such blocks cause the shock waves to spend a part of their energy or deviate stock waves out their direction. Each of said blocks can include an envelope from concrete that is then filled with sand by means of dredger. The analysis of bottom topology and possible shock wave directions allows calculating the form and the sizes of those obstacles. Said block directs and rejects a water flow upwards, forcing it to lose though a part of its energy at transitions of borders "water-air" and "air-water". Such rigid designs will promote also to growth of colonies of corals.

Figure 12A:
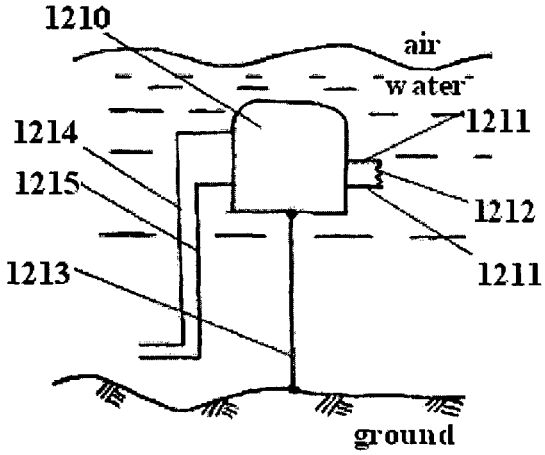
FIG. 12 represents an apparatus for an active means protection against shock waves.

FIG. 12A represents an apparatus for an active protection against shock waves. This apparatus can use a pin-point explosive. An electrohydraulic shock wave generator (ESWG) 1210 can be used convenient. This generator is encased in a hermetic housing and made in the view of an anchored float 1213. It may be placed above sea bottom, on sea bottom or buried into bottom ground. It comprises two electrodes 1211 that is brought to the external panel outside. The generator is connected to electric energy source by a cable 1214. A central supply line or local source, as in Bio-Wave station (BioPower Co., Australia) or Tidel (SMD Hydrovision, England) can be used. Small capacity of said stations is not an obstacle as the waiting time of such shock wave is not less year. The generator 1210 can be switched on according to signal that is transmitted on a cable 1215. This signal is generated by from own gauge or the distributed networks of gauges that are detecting a shock wave or tsunami, for example, Global Sea Level Observing System—GLOSS or Deep-ocean Assessment and Reporting of Tsunami—DART.

Figure 12B:
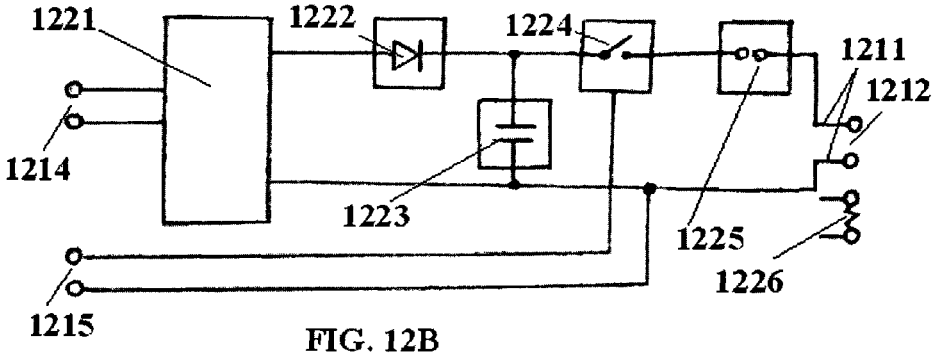

FIG. 12B shows a base structure of said (ESWG) 1210 according to well-known publication of Yutkin L. A., "The electrohydraulic effect and its application in industry, 1986, L., USSR, (in Russian)". An input block 1221 is connected to an electrical energy source (it isn't shown) by the cable 1214. The block 1221 increases a value of input voltage (for example, a transformer). A block 1222 rectifies said voltage and charges a capacitor unit 1223. A signal 1215 turns on an isolating key 1224, and the capacitor voltage through a forming unit 1225 (sharpening front of the signal of the capacitor discharge) is transmitted to a spark gap 1212 between electrodes 1211. It is possible to use the open spark gap 1212 or a conductive element (a metallic band, wire or a conductive paste) connecting the electrodes 1211 for thermo explosion. The thermo explosion of a copper wire (in diameter 1-2 mm and in length 50-300 mm) by the capacitor voltage that is equal to several kilovolts (by capacitance 1 microfarads and tens of kilojoules) can produce the pressure up to 1000 bars. Such explosion produces a hydraulic shock and generates a cavitations' cavity filled with vapor-air mix. This cavity extends sharply and causes moving and deviating considerable water masses. Such explosive is capable to weaken a said shock wave.

Figure 12C:
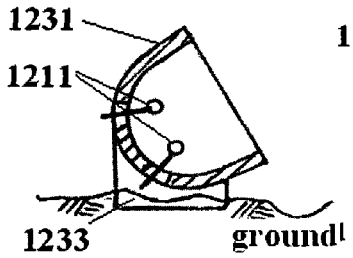
Figure 12D:
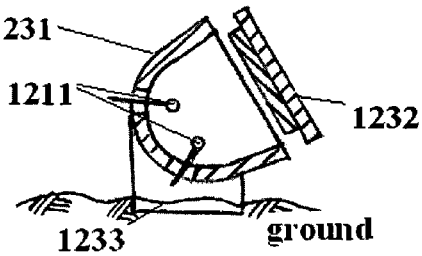

FIG. 12C and FIG. 12D show that the concentrators of energy may be made from concrete and fixed on the bottom 1233. This concentrator comprises the housing 1231 having corresponding shape. The electrodes 1211 are located inside the housing 1231 in the focus area. The concentrator shown in FIG. 12D is capable to throw its heavy cover 1232.

Figure 12E:
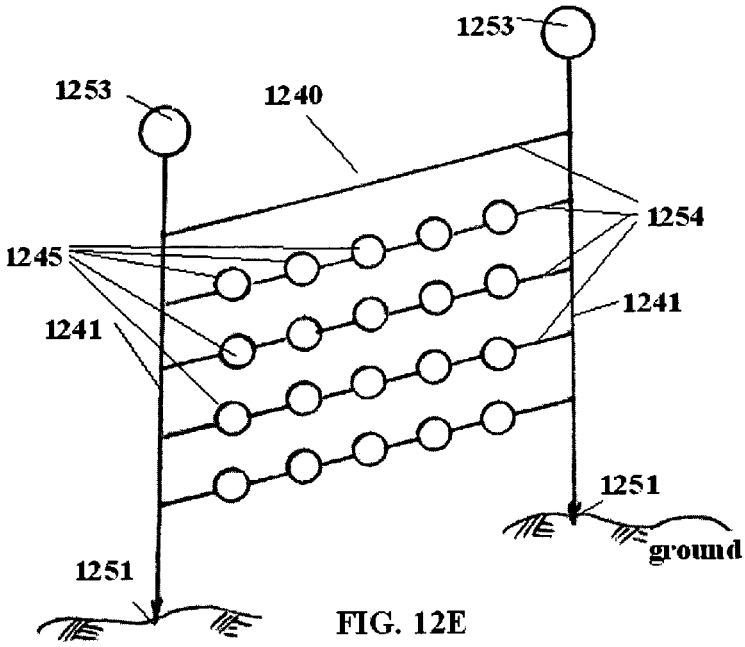
Figure 12G:
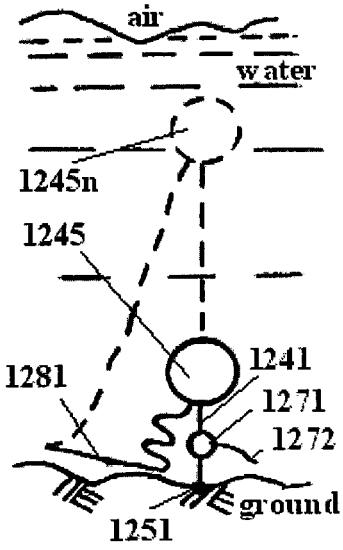

FIG. 12E represents a net 1240 comprising a plurality of said ESWG 1245 that are connected to each other by connecting lines 1254. Said lines 125 are connected by vertical line 1241 that are connected to floats 1253 and anchored 1251 to sea bottom. Said nets may be located vertically or at predetermined angle to the vertical. The nets may have plane or concave shape. FIG. 12G shows similar ESWS 1245 fixed to sea bottom by a lengthened cable 1241 and connected to control subsystem (it isn't shown) by cable 1281. An unit 1271 controls lengthening said cable 1241 according to signal 1272 from gauge subsystem (it isn't shown).

Figure 12H:
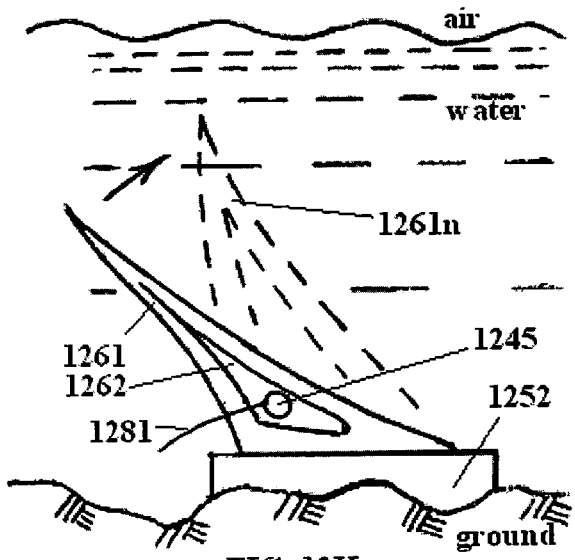

FIG. 12H represents elastic "sport fins"-like device 1261 fastened to ground 1252 (sea bottom or earth surface) and a cavity 1262, comprising said ESWG 1245 that is connected to command subsystem (it isn't shown) by cable 1281. By receiving said command said device 1962 straightens (1261*n*) and created a strong wave. Said device less acts to environment.

FIG. 13 represents an artificial dam which can be created in a critical situation, first of all, for operative struggle against ruptures of small dams during flooding. FIG. 13A shows schematically a dam 1310 and a rupture of an earthen dam (1311) that is located between two earthen walls 1310 or rupture of said SB (it isn't shown). In FIG. 13A it is shown a palisade 1330 of columns-piles established from the helicopter-crane as it was shown above (FIGS. 4B, 4C and 4). This palisade can be established quickly enough. A diameter of said piles (rockets) and their length are defined by current conditions. FIG. 13B shows a said palisade 1330 location between riversides 1310 for creation of a cofferdam between riversides 1320 on a way of water flow.

Figure 13A:
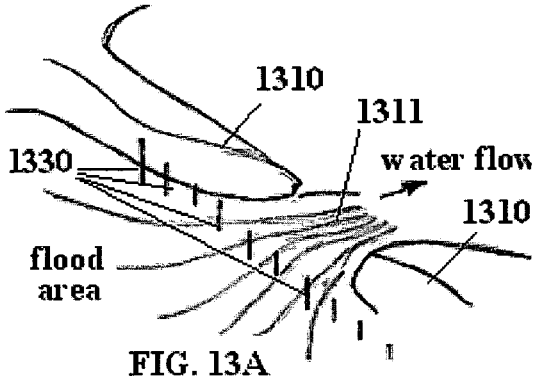
FIG. 13 represents repair means using piles-rockets as a support.
Figure 13B:
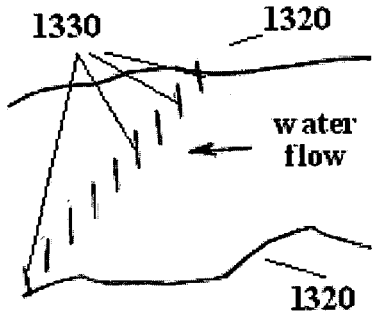
Figure 13C:
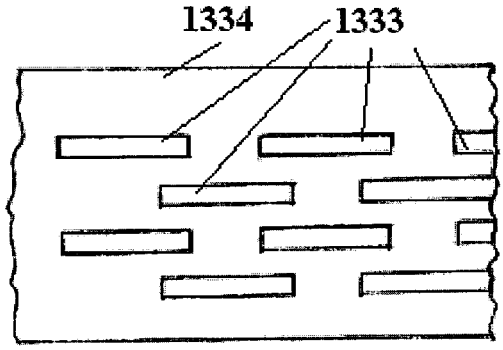

Further repair means for dams repair means is described. repair means comprises a web 1334 that is shown in FIG. 13C. On this web 1334 a set of members 1333 is fixed parallel to each other approximately. They can be executed in the form of rods of continuous cross-section, tubes or to have a figured profile. Each such member can consist of separate pieces or in the form of unified member. The length of pieces should be not less than double distance between said vertical piles 1330 (FIG. 13A).

Figure 13D:
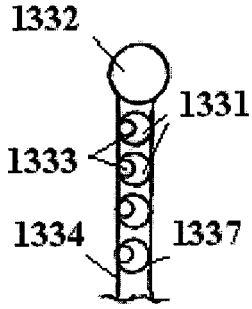
Figure 13E:
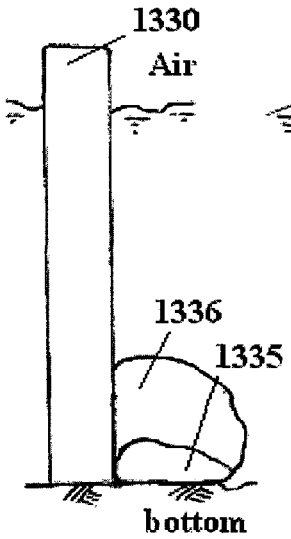

The sleeves 1332 and sleeves 1335 that are attached to said web 1334 from two opposite parties (top and bottom accordingly) are shown in FIG. 13D-FIG. 13E. The sleeves 1331 may be filled with water, and it is desirable for maintenance of flat form of said web 1334. The heavy sleeves 1335 are filled with sand that allows pressing said bottom edge said web 1334 to bottom. For decreasing water infiltration between edges of said web 1334 and riversides 1320 or dam walls 1310 (FIG. 13A and FIG. 13B) said members 1333 that are located along lateral edges of said of said web can be moved out toward the nearest walls. Each of such members (or their parts) comprises, for example, a telescopic or self-propelled core (pipe). It is more useful variant if said lateral members are executed hollow in the form of a gun trunk. Each of such trunk may be launched as the core-rocket horizontally aside coast, and said rocket sticks to the riverside 1320 or the dam wall 1310. Such core-rockets 1338 comprises the small-sized solid-state jet engine, and the member should be organized as recoilless device (if the members are executed as a single whole then recoilless is solved automatically at simultaneous switching on of engines on both ends). Said engines should be switched on right after lifting said sleeve 1332 on water surface. To close said cracks between said web and coasts (walls), said web can include the flexible sheets 1339 attached by the lateral parties of said web. The edges of these sheets are attached to head parts of said rockets. It allows to pin the sheet edges to coasts or walls and to close lateral cracks. It is possible to make the ends of the lateral members more springy 1337 that are fastened to web 1334 (FIG. 13H and FIG. 13J). This allows directing a harpoon 1339 to the riverside or dam's wall more precisely.

The sequence of installation of said barrier is following:

1) helicopters deliver a set of column-rockets to the predetermined place from flooding and hover above it, 2) rocket engines are switched on and are launched these column-rockets aside bottom upright down (heavy columns could fall under action of a body weight, but the weight of columns is limited by carrying capacity of helicopters), 3) the same or other helicopters deliver said repair means that being in the collapsed state in the view of package 1336 containing the web with cores, sleeves 1332 and sleeves 1335, 4) this package is dropped upright down so that it is pressed to said columns by water flow (FIG. 13B), 5) sleeves 1332 (one or more) are filled with air (gas) from the pump (is not shown) or balloons of compressed gas (air). These balloons may be dropped to bottom by said helicopters.

Figure 13F:
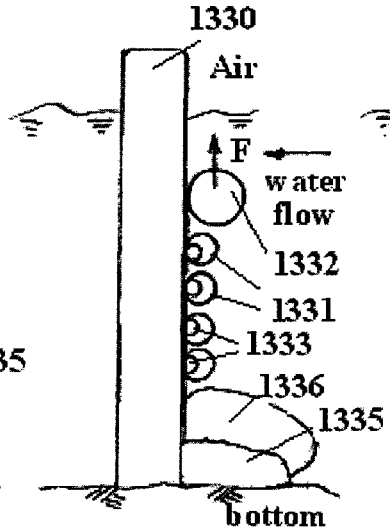
Figure 13G:
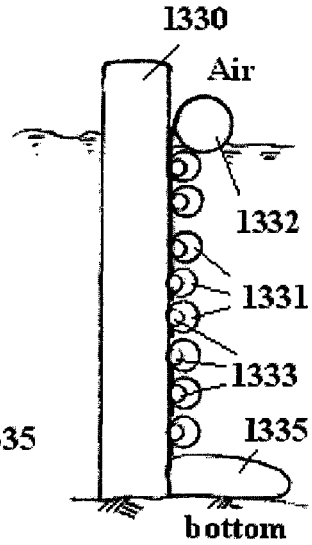
Figure 13H:
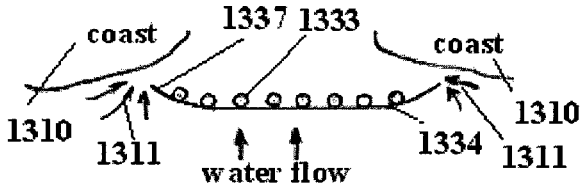
Figure 13J:
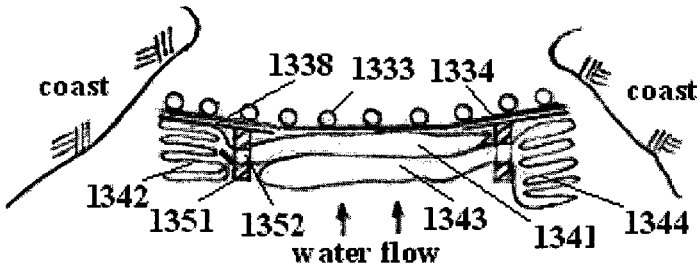

6) The following step—said package 1336 gets smoothed out (FIGS. 13E-F). FIG. 13G represents the following step: at least, one of sleeves 1332 has risen on water surface, the barrier is straightened. Further said cores 1338 are launched, get into the coastal ground, extended and pressed the lateral flexible sheets 1339, closing lateral cracks between said web 1334 and coast 1310.

In FIG. 13H-L the sequence of actions at installation of said barrier is shown. The state FIG. 13H (fragment) shows that the unfolded web 1334 is pressed to piles 1333 by water flow and closes a rupture between coast 1310 and said web 1334. The water flow 1311 passes between said edge of said web 1334 and coast 1310. FIG. 13J shows cavities 1341, 1343 and 1342, 1344 attached to said web 1334. Each cavity consists of a bag 1341 and a tongue 1343 (1342 and 1344, correspondently). Said bags and said tongues are made from high-elastic soft material. Between said tongue 1343 and said web 1334 said housing of harpoons 1338 are fixed. Said tongue 1343 and corresponding bag 1341 are connected through an aperture 1352 (them can be a little) in a holder 1351 fixed on said web 1334. Inside this aperture 1352 the valve 1353 is placed. This valve 1353 closes said aperture 1352, if pressure from outside tongue 1342 more pressure in the bag 1341. The connections between said apertures 1352 may be made in the view, for example, a bayonet connection.

Figure 13K:
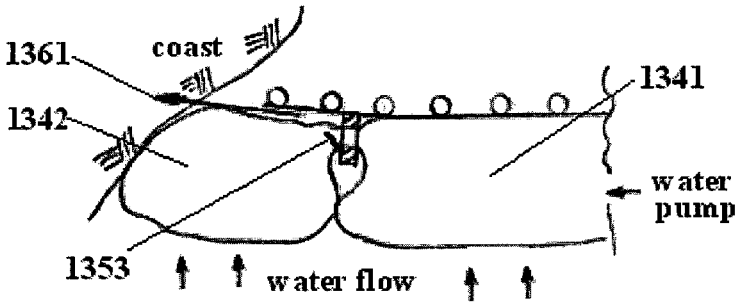
Figure 13L:
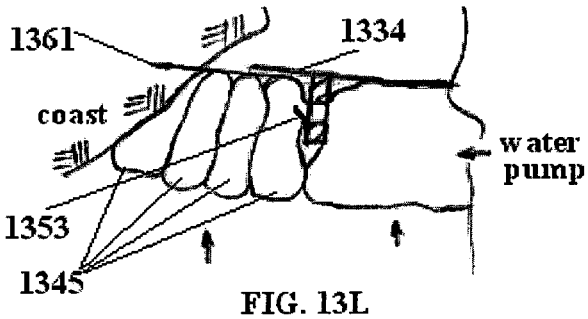
Figure 14:
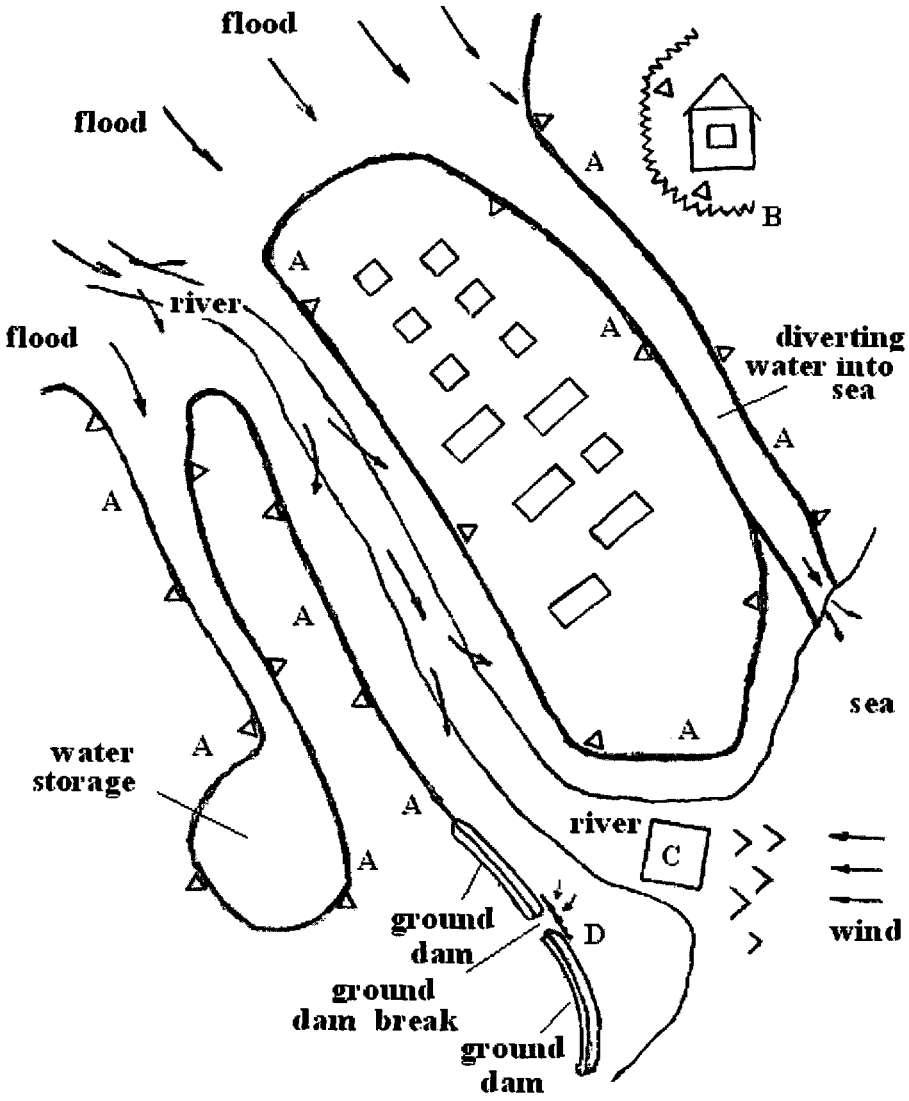
FIG. 14 shows the general picture of district during flooding and use of offered embodiments of the present invention in uniform protective flood barrier system.

After a "shot" of said harpoons 1361 said zone between said web 1334 and coast is blocked by a lattice of the harpoons 1361 connecting said web-barrier 1334 to the coast. A pump (it isn't shown) for filling said bags 1341 (and sleeves) and said tongue 1342 with water (and air) is dropped together with a rolled package of said web (FIG. 13K). Said tongues being inflated block said zone 1311 and press to said coast by increased pressure. It is necessary, that the area of said bags 1341 that are covered said web, being under water flow pressure, it would be substantially more than the area of said tongues 1342 that is equal to said web area, on which water flow acts, it would be essential more than the area of the tongue 1342, on which also water flow acts (FIG. 13K). Improving this relationship is possible, using sectioning of said bag 1341 or said tongue, for example, as 1345 (FIG. 13L). The timer (it isn't shown) that is turned on at the moment of dropping.

FIG. 15 represents an example complex the system, including protection of separate houses by surrounding house the mobile barrier, protection from surge waves collapsible pontoon located on sea surface from atmosphere barrier, repair means for repairing rupture of earthen dam and mobile barrier, and the basic quick-installable barrier for territory protection, and also active and passive means of underwater protection, used for protection of territory, for protection of coast of the river, for creation of the channel for water drainage, as walls of a water basin, etc. They have a cheap design, accessible to mass production, allows preparing quickly theirs for protection against flooding.

The system provides an opportunity of preliminary installation anchor blocks (concrete or metal) as during preparation for expected flooding, and at the last minute, using helicopters. This system assumes that preliminary analysis of area, history of floods and FEMA's maps had been made, and the dangerous places, ways of water removal and the locations of water storage basins had been defined, and anchor blocks had been mounted in necessary places and necessary equipment for creating protective barriers had been prepared.

The given application represents a system of means which can be used at creation of the barrier system protecting from flooding of a different origin, on the basis of the same means, enough cheap and (it is important) providing operative installation of said protective means.

We claim:

1. A protective flood barrier system, comprising a plurality of mobile barriers intended for the protection of separatelysituated objects against flood, mounted around said objects on the ground and using components available for the owner of each separate house or object;

said protective flood barrier system, wherein:

(i) said mobile barrier comprises:

a rigid, geometric invariable, statically-determined spatial skeleton built of the base of straight members, chosen from bars, tubes, special profiles, or combinations thereof, and connecting elements on the base of a collapsible construction equipment, and said skeleton is pressed against the ground;

an elongated impermeable web having at least one bend in a cross-section direction that divides said web into two longitudinal strips: a first front strip and a second bottom strip, respectively, the first strip having width that is no less than the height of said front members, and the height of said front members is more than expected height of flooding water, said second strip having width that is no less than a bottom face of said skeleton extended in a direction that is perpendicular to front face, and said width is sufficient for predetermined infiltration weakening;

fixing means keeping said skeleton at a predetermined place, and preventing the displacement of said barrier under a flood action;

(ii) said mobile barrier is characterized in that:

said skeleton is formed by a number of front upwardly-extended and slightly slanting back said members, aligned in a row approximately equidistant between adjacent ones around one of said objects, the top ends of adjacent front members are connected to each other, the lower parts of adjacent members are connected to each other similarly, and each of said top ends is fixed additionally at least to one, two or more supporting members so that lower ends of said supporting members are tilted at an acute angles with respect to the ground;

said front members have a height that is no lower than the expected height of flooding water;

said web is bent and fastened on said skeleton covering said skeleton at the front and from below, so that the external edge of the first strip is fastened to the top ends of said front members and/or to such members that connect said top ends from above, and the opposite edge of the second strip is fastened so that said second strip fully covers said skeleton from below;

(iii) said mobile barrier is characterized further in that:

the distance between said front members and corresponding supporting members is chosen so that the width of the second strip is sufficient for predetermined infiltration weakening and necessary stability of said barrier position;

said fixing means are chosen from followings:

1) pressing means, using heavy ballast; 2) holding means, but only in a horizontal direction; 3) holding means in a horizontal and a vertical directions; 4) a combination thereof;

said protective flood barrier system, characterized in that said system further comprises, in addition, said mobile barriers, one or more types of additional means intended for the weakening of fast-growing water streams caused by natural or technogenic disasters, against which said mobile barriers are powerless, and said additional means are chosen froth followings:

1) a quick-installable barrier, comprising two elongated, spaced apart, parallel sleeves having flexible impermeable envelopes, filled with water and/or wet sand, connected to each other by an elongated flexible impermeable web located on the ground in the path of flood, and wherein said web comprise built-in or attached forming means for smoothing out said web at installation;

2) active means for weakening tsunami-like waves by pushing out the growing wave into air and breaking up the water mass hump, and that are mounted in the sea in the places where the growth of the water masses is possible;

3) collapsible pontoons that are capable of floating on the water surface and are intended for weakening the wind action and falling air pressure on surge waves and the flood's initiation;

4) repair means for embedding ruptures of existing dams of mainly terrestrial type and/or water streams blocking; and 5) a combination thereof.

2. The protective flood barrier system according to claim 1, characterized in that at least part of the surface of said barriers, along which strong water streams move, is made or is covered with a material chosen from following: a superslippery coverings, a material having an antiturbulent relief, or a combination thereof.

3. The protective flood barrier system according to claim 1, wherein:

a part of said barriers, that is characterized in that said web and sleeves or their part is directly pressed to the ground surface, and at least a part of the lower surface of said web and sleeves, adjoining to the ground, is made or is covered with a material chosen from the following: a hydrophobic material or covering, an extensible material covering said bottom surface, or the special means that are chosen from the following: a glue, a cement, a high strength composite, or a high adhesive material, depending on property of corresponding part of terrestrial surface, which is placed on a ground or a rigid surface like an asphalt.

4. The protective flood barrier system according to claim 1, wherein said anchor blocks are chosen from the following:

preliminary buried anchor blocks;

quickly installed piles;

said buried anchor blocks are made from concrete, metal or plastic material and include socket(s) that are equipped in the upper part with threading or latch for fixing a screw or plug;

at least a part of said piles are equipped with an jet engine located inside the upper part of said piles or additional weight.

5. The protective flood barrier system according to claim 1, wherein said collapsible pontoon separates water surface and atmosphere, intended for weakening processes causing flood, and comprises:

(a) a plurality of sleeves with flexible impermeable envelopes, one part of said sleeves is intended for filling with air, another part—with water, and said pontoon is configured so that the center of gravity of said pontoon coincides with the geometrical center, and so that said sleeves being filled with water and air are capable of ensuring the positive buoyancy of said pontoon;

(b) one, two, or three webs fastened to said sleeves;

(c) control means fastened to said pontoon surface, which are turned on in response to an external signal or automatically at the instant when said pontoon reaches the sea surface;

(d) air-compressed cylinders or air pumps and water pumps located on the sea bottom or fastened to said corresponding sleeves, and connected to said sleeves by connecting flexible tubes;

(e) energy sources controlled by said control means and chosen from the following: fuel cells, oil engines, or accumulating devices;

said protective flood barrier system, wherein a structure of said collapsible pontoon is chosen from the following:

a ruled structure, wherein said sleeves are placed in parallel fastened at predetermined distance;

a cellular structure, wherein said sleeves are assembled in bundles, each of said bundles comprises one or more separate sleeves and said bundles form a cellular structure including one or more round or n-gon cells;

a combined structure;

said protective flood barrier system, wherein said pontoon comprises also fixing means intended for holding said pontoon at a predetermined place, chosen from the following:

anchors fastened to sea bottom, coast, or to special columns, witches placed on the coast, sea towboats connected to said pontoon by cables or embedded into said pontoon, or a combination thereof;

said protective flood barrier system, wherein said pontoon being in normal conditions is pleat in the form of a package and is placed on the sea bottom;

said protective flood barrier system, wherein in case when said collapsible pontoon being in floating state on the sea surface, corresponding sleeves are filled with air, and a total air volume is sufficient for withholding of said barrier on water surface at necessary level, corresponding sleeves or/and chambers are filled with water and a total water masses is sufficient for withholding of said pontoon on water surface and overcoming a lifting force produced by the wind of atmospheric pressure falling;

said protective flood barrier system, wherein said pontoon is configured so that in case of danger said system is capable of filling said sleeves with water and air and providing unfolding and lifting said pontoon from the sea bottom.

6. The protective flood barrier system according to claim 5, wherein said collapsible pontoon is placed in the form of a folded package on the sea bottom, comprises at least two pairs of cables fixed to two opposite short side of said pontoons;

said protective flood barrier system, wherein the first embodiment of said pontoon is characterized in that second ends at least one of said pairs of said cables are fixed to winches located on the coast or to towboats that are capable of stretching said cables and unfolding said pontoon and fixing said pontoon at a predetermined place;

said protective flood barrier system, wherein the second embodiment is characterized in that a plurality of sliding elements are fixed to said pontoon along two opposite long edges of said pontoon symmetrically and in regular intervals, and said pontoon is suspended with the help of said sliding elements to the special guide-cables stretched between remote points of coast and anchored in said points;

said protective flood barrier system, wherein the second embodiment is further characterized in that the additional cables, fixed to opposite short sides of said pontoon and to winches fastened to coast, allow stretching said pontoon;

said protective flood barrier system is characterized also in that said stretching said pontoon is combined with synchronous filling corresponding sleeves with water and air.

7. The protective flood barrier system according to claim 5, wherein said collapsible pontoon of cellular structure includes one from the following webs chosen from the group:

(a) an oil-like web formed by cod-liver oil-like that is leaked from the openings located on the sea level in the downwind internal side of separate cell chambers and connected to oil source(s) located inside at least one of said sleeves and supported by oil-philic material on the other side of said interior or hydrophobic film for wave weakening;

(b) one plastic web placed from above said pontoon, the top surface of which is chosen from followings:

1) one smooth simple web that allows weakening the effect of wind on the sea surface;

2) one smooth sun-rays reflecting web that allows weakening the effect of wind on the sea surface and preventing the heating of sea water by sun rays;

3) one smooth sun-rays reflecting and high heat conduction web that allows cooling the sea surface additionally by the action of airflow;

(c) one smooth sun-rays reflecting heat conduction plastic web from above, and another heat isolating web from below, that allows forming inside said cells closed chambers that allow in the case of filling said chambers with cold water from an external source using said cold only for cooling ambient air, for the prevention of the development of hurricanes; and (d) a combination thereof.

8. The protective flood barrier system according to claim 1, comprising said repair means intended for stopping local water flow, in particular, river or caused by the rupture of dams or barriers, and wherein said repair means comprise:

a top sleeve having flexible impermeable envelope for filling with air;

one or more chambers chosen from the following: compressed-air cylinders and/or air pumps that are connected to said top sleeve and intended for filling said top sleeve, chambers filled with sand or ground, a combination thereof;

a flexible impermeable web connecting said sleeve and said chambers so that said sleeve and said chambers are fixed along opposite top and bottom edges of said web, and the width of said web is more than the width of said water flow;

a plurality of piles, the length of which is more than said water flow deep;

web forming means comprising a plurality of solid rods or tubes having length that is no less than double distance between said piles in the process of their instillation, said rods are fastened to said web approximately uniformly in parallel to top edge of said web at a predetermined distance;

means for weakening water leakage between said web and rupture walls and bottom;

said repair means further comprising two groups of lateral straight members fastened to lateral opposite edges of said web and stretched by spreading means chosen from the following:

1) rigid spreaders in the form of metal or plastic strips, said spreaders being attached to the bottom party of said web in parallel to the water surface bottom approximately and located at regular intervals approximately along said barrier;

2) rigid springy ribs chosen from the group, including: springy plastic, a whalebone, an alloy with shape memory, fixed on said web in parallel to the water surface bottom approximately and fastened to the external side of said web;

3) tube-like ribs that are made in the form of elastic tubes that are fastened to the external side of said web and located similarly, said tube-like ribs are connected to said cylinders for filling with air or to water pumps that are located in said bottom row together with energy sources;

4) bladders having flexible envelope and widened by air or water pumps that are located in said bottom row together with energy sources;

5) delivery means;

said protective flood barrier system, comprising said repair means, and wherein:

said web is characterized in that the distance between said top sleeve and said heavy chambers is no less than water deep, and the width of said web is more than the width of said rupture or water stream;

said delivery means comprise helicopters, mainly helicopters-air cranes that are adapted for dropping said piles and said web together with said empty sleeve and full chambers;

said protective flood barrier system, comprising said repair means, and wherein said repair means:

(i) are configured to perform in response to danger signal following sequences of actions for embedding the rupture in the dam:

a delivery of said piles by said air crane and dropping them so that they form a palisade overlapping said rupture on the side of water stream;

a delivery of said web together with said empty sleeve and said chambers, dropping said web together with said empty sleeve and said chambers so that said web is laid along said palisade on the side of water stream, and filling said sleeve with air from said chambers or pumps when said sleeve reaches water surface so that the floating sleeve pulls up said web and blocks said rupture;

pulling said lateral members and/or expansion of said forming means for lateral water leakage weakening;

(ii) comprise fastening means for weakening of water leakage between said web and said dam walls, and said fastening means:

in the case of a ground dam including two groups of harpoon guns that are fastened to two lateral opposite edges of said web, directed to opposite walls of dam rupture in parallel to water surface and connected to corresponding aprons by short ties, said two groups of harpoons being located inside said guns, said harpoons being chosen from the following: guns using a string for launching said harpoons, harpoons having a embedded solid-state jet engine, two groups of bladders having flexible envelope, said envelopes being covered with a high-elastic hydro-phobic wool-like material;

in the case of quick-installable barrier rupture said means include two groups of bladders having flexible envelope, said envelopes being covered with material chosen from following: high-elastic hydrophobic wool-like material, hook-and-loop fasteners covering, high-adhesive covering, and said material covers corresponding to the places of said bladders which are pressed to said walls at the expansion of bladders;

(iii) are characterized in that said hook-and-loop-like fasteners covering of said bladders for repairing of the quick-installable barrier is intended to be used if said front sleeve of said installable barrier is divided into separated sections, said sections are connected to said source of said filler independently and if the places of external surface of front sleeve of said quick-installable barrier are covered with hook-and-loop-like fasteners;

(iv) are characterized in that when the width of said rupture is more than the width of said web then said rupture is closed by several webs together with said sleeves and chambers, said webs are installed across said rupture with overlapping, and edges of adjacent repair means comprising only said bladders as fastened means.

9. The protective flood barrier system according to claim 1, wherein an analysis of maps of the protected territory, a flood prehistory, a weather forecasting and a plurality of objects placed on this territory defines the placing of one or more said barriers in compliance with expected height of flood, so that the height of mounted barriers is not below than the height of flood water and further, correspondently:

1) said mobile barriers are placed around separate houses and important objects, protecting against flood;

2) said quick-installable barriers, comprising two said parallel sleeves and intended for the protection of large areas, are placed in the flood's path before said mobile barriers, to limit the height of leaking water and protection a sizeable territory and said mobile barriers against high water;

3) said collapsible pontoons are placed in a river mouth or a narrow bay, protecting the river coast against surge wind-induced waves;

4) said active means for weakening tsunami-like waves are placed in supposedly dangerous places underwater, in the path of expected waves near a bend of sea bottom where a sharp growth of wave is predetermined;

5) said repair means, including helicopters, are placed near dangerous dams and in the areas where the forming of dangerous water stream is possible;

said protective flood barrier system, wherein:

(i) said quick-installable barriers further are intended for the creation of special channels protecting against flood and giving additional possibilities for people salvation;

(ii) said analysis allow for determination of the places for the effective location of barriers and for making ready a plurality of preliminary buried anchor blocks that will allow for quicker and more reliable installation of said mobile barriers and quick-installable barriers in case of flooding.

10. The protective flood barrier system according to claim 1, comprising said mobile barrier fixed to the ground by said holding means fixing in all directions said mobile barrier comprises an elongated sleeve consisting of one or more sections that are located either:

between the top surface of said second strip and elongated straight members connecting lower members of said skeleton so that at the filling said sleeve is clamped between said elongated straight members and said second strip, pressing said second strip to the ground; or between the second strip and the ground so that at filling this sleeve is clamped between the second strip and the ground, pressing said second strip to said straight members and a lower surface of said sleeve to the ground;

said sleeve is connected by tube(s) to one or more chambers located above than this sleeve and filled with water or chamber(s) filled with compressed air that are capable of creating increased pressure inside said sleeve;

said mobile barrier, wherein further the lower surface of the second strip or said sleeve that is placed on the ground is covered with a hydrophobia cotton-like layer.

11. The protective flood barrier system according to claim 1, comprising said mobile barrier;

said mobile barrier, wherein:

(a) said pressing means that are made in the form of chambers filled with sand and/or water, and comprising a heavy ballast chosen from the following: stones, metal blocks, concrete blocks, bricking blocks and/or other heavy weights, or any their combination, located on top of said chambers or directly on the top surface of said second strip;

(b) said fixing means holding only in a horizontal direction that are made in the form of rigid ledges, rods, pins, fixed to the bottom surface of the second strip or on the bottom part of said bottom straight members;

(c) said means that are capable of holding in all directions that are made in the form of screws that are capable of being screwed into the ground or plugged in latches intended to be locked into the anchor block preliminarily buried in the ground; and (d) a combination thereof;

said mobile barrier, wherein further:

said holding means fixed on lower part of said straight members are characterized in that said holding means either are fastened to said members, being their extension downwards, or are fastened to the bottom part of the horizontal members that connect the front members and/or the supporting members to each other;

said holding means are characterized in that in the case when said holding means penetrate via said strip the said holding means are surrounded by ring hydrophobic collars to prevent water leakage.

12. A quick-installable barrier, comprising two elongated, spaced apart, parallel sleeves, having flexible impermeable envelopes, filled with water, sand or a combination thereof, and connected to each other by an elongated flexible impermeable web, mounted on the ground in the path of flood and blocking the protected zone against oncoming from water flood;

said quick-installable barrier, comprising forming means that are placed along said elongated web and are fastened to said web and that are intended for smoothing out said web, moving apart said sleeves at a predetermined distance from each other, releasing a place for loading ballast;

said quick-installable barrier, wherein said forming means are chosen from the following:

rigid spreaders that are made from metal or plastic strips, said spreaders are attached to the bottom party of said web perpendicularly to the barrier axis and located at regular intervals approximately along said barrier;

rigid springy ribs chosen from the group, including: springy plastic, a whalebone, an alloy with shape memory springy plastic, a whalebone, or alloy with shape memory, fixed to an external envelope of said sleeves and fastened to said spreaders;

tube-like ribs that are made in the form of elastic tubes that are connected through one or more tubes to water or compressed-air source and must be filled primarily;

flat plates, having corresponding transverse sizes, placed on top of said web along said sleeves almost side by side, the form of which is chosen from the following: continuous flat plate, plate in the form of flat ladder or in the form of flat lattice;

said quick-installable barrier, wherein in the case if said forming means comprise flat central parts and lateral parts, said lateral parts being attached to said web or built-in into said web, the length of which is equal to the width of said web approximately and short lateral parts directed to sides at an acute angles with respect to the ground that are capable of moving apart said envelopes of lateral sleeves, releasing space for loading ballast;

said quick-installable barrier, wherein said forming means are fastened to said web perpendicularly to the barrier direction and located at regular intervals approximately along said barrier;

said quick-installable barrier, wherein in case of the use of said flat plates the lower surface of said plates are covered with hydrophobic cotton-like material;

said quick-installable barrier, comprising heavy ballast located between said sleeves and ensuring the barrier stability and weakening infiltration between the lower surface of said web and the ground;

said quick-installable barrier, wherein a diameter of the front sleeve faced to water flooding is no less than the expected flood water height, and a width of said web and a width of said ballast are sufficient for necessary infiltration weakening;

said quick-installable barrier, wherein said ballast is chosen from the following: sand, sand bags, sand boxes, stones, pulp, metal, concrete, water, various combinations thereof.

13. The quick-installable barrier according to claim 12, comprising additional means allowing for the organization and acceleration of the installation of said barriers, chosen from the following:

an overhead conveyor mounted on special vehicle, a pump for filling said sleeves with water or wet sand, and an equipment for ballast loading;

said quick-installable barrier, comprising:

a plurality of pairs of sliding elements that are fixed to both opposite edges of said web equidistantly intended for mounting on corresponding rigid guide-rails of an overhead conveyor that is configured to be installed on a special vehicle, and a step of said pairs location must correspond to conditions of said conveyor; and wherein said quick-installable barrier characterized in that said web and envelopes of empty said sleeves are preliminary folded in the form of a package, and said package is suspended from said sliding elements to said guide-rails;

said quick-installable barrier, including empty said sleeves suspended together with said web to said conveyor, is configured for:

a) joining up said sleeves to said pump subsystem via corresponding branch pipes located on one end of said sleeves;

b) fastening said end to ground;

c) moving said vehicle along predetermined line;

d) deployment of said barrier system package and stowing said empty sleeves and web on the ground at removal of said vehicle from a place of fastening said sleeves, executed automatically in moving said vehicle and discharging said conveyor;

e) filling said sleeves with water from said pump subsystem and erecting said tube-like spreaders; and f) loading ballast on said web between said sleeves;

said protective flood barrier system, wherein said steps c), e), and f) are carried out concurrently or independently;

said protective flood barrier system, characterized in that in case the said forming means are made in the form of flexible inflated spreaders, and said spreaders are additionally connected to special pump subsystem concurrently with step a), and filling said spreaders with water and/or air is concurrently with step e), or independently;

said system, wherein said web is equipped by openings in the form of cringles or other means for fastened said web to ground or anchor block.

14. The quick-installable barrier according to claim 12, comprising an additional means for pressing said web to the ground, said means are attached to a vehicle or made on the base of a separate mini-tractor having nonmetallic tires or track; and capable of moving between said sleeves, pressing said web to the ground;

said quick-installable barrier, wherein the lower surfaces of said web and/or said sleeves are covered at least partially with high-adhesive covering or material, and wherein said space between said parallel sleeves makes possible the use of:

(1) a flexible roller attached to the mini-tractor that is intended to move between said sleeves, pressing said web from above to the ground, to weaken infiltration between said web and the ground to increase the stability of said barrier; and/or (2) a stapler-like mechanism fastened to said tractor for nailing said web to the ground with the help of nails, pin-plugs, sharp pins or screws directly or the intermediate tape pressing said web to the ground;

said quick-installable barrier, characterized in that in case of the use of both said mechanisms, said mechanisms should be used consistently in said order.

15. Active means for weakening and protection against expected tsunami-like waves, comprising a plurality of electrohydraulic shock wave generators mounted underwater in the path of expected waves near a bend of sea bottom where a sharp growth of wave is predetermined, and that are chosen from the following:

i) mounted on the sea bottom near said bend of bottom where a sharp growth of wave is predetermined;

ii) mounted into sea water mass and fastened in upright position with the help of anchors and/or floats;

iii) mounted inside the focus area of solid concentrators fixed to sea bottom and faced in the expected direction of said tsunami-like wave, the allows for focusing said stock wave created by said built-in generators in the direction of the approaching tsunami-like wave;

iv) mounted inside sport fins-like elastic devices located near said bend of sea bottom and capable of, after a kick of build-in said generator, becoming sharply straight and pushing out a large water mass upward; and v) a combination thereof;

said active means, configured so that said stock waves that are generated by said generators was capable of spraying the water mass thrown out into air and reducing the energy of said water mass due to the losses by overcoming of the air resistance;

said active means, wherein:

each of said electrohydraulic shock wave generator comprises two electrodes, a capacitor connected to said two electrodes at least through one controlled isolating key and sharpening unit, said capacitor is connected to an energy source through a voltage multiplier by a cable, said controlling input of said key is connected to an external controlling station or a tsunami-like wave sensor system, and said generator is located inside an air/water tight housing, and said cables are isolated from water;

said electrodes are mounted on the external surface of said housing so that said electrodes are isolated from one another, and a predetermined gap between said electrodes is intended to be used as spark gap or for the evaporation of a metallic wire connecting said electrodes;

said active means, wherein said energy source is a ground-based electro station or a wave energy convertor.

* * * * *